US009561673B2

(12) United States Patent
Kokuta et al.

(10) Patent No.: US 9,561,673 B2
(45) Date of Patent: Feb. 7, 2017

(54) PRINTER

(71) Applicant: SATO HOLDINGS KABUSHIKI KAISHA, Tokyo (JP)

(72) Inventors: Hiroshi Kokuta, Tokyo (JP); Akira Nakajima, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/107,587

(22) PCT Filed: Dec. 25, 2014

(86) PCT No.: PCT/JP2014/084336

§ 371 (c)(1),
(2) Date: Jun. 23, 2016

(87) PCT Pub. No.: WO2015/099057

PCT Pub. Date: Jul. 2, 2015

(65) Prior Publication Data

US 2016/0318320 A1 Nov. 3, 2016

(30) Foreign Application Priority Data

Dec. 26, 2013 (JP) ..... 2013-268269

(51) Int. Cl.

| | |
|---|---|
| ***B41J 15/16*** | (2006.01) |
| ***B41J 15/04*** | (2006.01) |
| ***B41J 3/407*** | (2006.01) |

(52) U.S. Cl.
CPC ..... *B41J 15/16* (2013.01); *B41J 3/4075* (2013.01); *B41J 15/046* (2013.01)

(58) Field of Classification Search
CPC ..... B41J 13/00; B41J 15/00; B41J 15/16; B41J 15/165; B41J 3/4075; B41J 15/046
See application file for complete search history.

(56) References Cited

U.S. PATENT DOCUMENTS

| | | | | |
|---|---|---|---|---|
| 6,132,119 | A * | 10/2000 | Nakajima | B41J 3/4075 400/207 |
| 2011/0103871 | A1* | 5/2011 | Van Coppenolle | B41J 3/4075 400/663 |
| 2011/0193927 | A1* | 8/2011 | Matsushima | B41J 15/16 347/218 |

FOREIGN PATENT DOCUMENTS

| | | | |
|---|---|---|---|
| JP | 8-157120 | A | 6/1996 |
| JP | 11-246092 | A | 9/1999 |
| JP | 2007-301869 | A | 11/2007 |
| JP | 2010-76851 | A | 4/2010 |

* cited by examiner

*Primary Examiner* — Kristal Feggins
(74) *Attorney, Agent, or Firm* — Foley & Lardner LLP

(57) ABSTRACT

At a printer that feeds a continuous paper unwound from a paper sheet supply unit in a sheet-shape to a printing head portion side via a damper portion, and then prints on a label of the continuous paper, the damper portion is made of a transparent material.

6 Claims, 24 Drawing Sheets

PRINTER

TECHNICAL FIELD

The present invention relates to a printer, for example, a printer having a function that prints desired information, such as a character, a sign, a diagram, a barcode, or similar information, on a print medium such as a label.

BACKGROUND ART

A label printer is a printer having a function that, for example, in the middle of unwinding a rolled continuous paper in a sheet-shape to feed the continuous paper along a feed path, prints desired information on each of a plurality of labels adhered temporarily on a long liner sheet, which constitutes the continuous paper.

At the label printer, between a paper sheet supply unit, which supplies the continuous paper, and a thermal head, which prints desired information on the label of the continuous paper, a damper portion, which gives tension to the continuous paper, is installed, and the continuous paper unwound from the paper sheet supply unit is fed to the thermal head via the damper portion.

The damper portion, which is a member that gives tension to the continuous paper, is typically biased downward by such as a spring. The continuous paper is set to slip under this damper portion to be fed to a side of a printing head.

It should be noted that, for example, JP2007-301869A discloses a printer that has such label printing function.

SUMMARY OF INVENTION

Now, since in order to set the continuous paper as described above, the continuous paper is slipped under the damper portion, a field of view is blocked by the damper portion, and thus setting the continuous paper is difficult. Addition, the damper portion includes a width guiding portion to prevent meander of the continuous paper, and this width guiding portion is also positioned just under the damper portion, when position-setting of the width guiding portion, the field of view is blocked by the damper portion, and thus position-setting of the width guiding portion is also difficult. Especially, because the position of the width guiding portion is adjusted by sense of touch where the width guiding portion abuts on an end portion in a width direction of the continuous paper, this position-setting operation may be a complicated operation.

The present invention has been made in view of the above-described technical background, and it is an object of the present invention to provide a printer that ensures the facilitated setting of the print medium.

To solve the above-described problem, a printer according to a first aspect of the present invention includes a medium supply portion configured to supply a print medium, feeding means configured to feed the print medium supplied from the medium supply portion along a medium feed path, printing means disposed in the medium feed path to print on the print medium, and a damper portion configured to swing to give tension to the print medium between the printing means and the medium supply portion, the damper portion being made of a transparent material.

In a printer according to a second aspect of the present invention of the printer according to the above-described first aspect, the damper portion includes a slide hole portion formed along a longitudinal direction of the damper portion, a pair of guide rail portions formed along the slide hole portion to sandwich the slide hole portion in a vertical direction, a width adjustment guiding portion configured to move along the slide hole portion and to guide the print medium to be fed in contact with an end portion in a width direction of the print medium, and a guide operating portion configured to turn and coupled to the width adjustment guiding portion at a position sandwiched between the pair of guide rail portions, the guide operating portion including a convex portion projecting in a radial direction to an outer periphery along the turning direction.

In a printer according to a third aspect of the present invention of the printer according to the above-described second aspect, turning the guide operating portion ensures fixing or fix-releasing a position of the guide operating portion.

In a printer according to a fourth aspect of the present invention of the printer according to the above-described second or third aspect, the width adjustment guiding portion is positioned on an inferior surface of the damper portion.

In a printer according to a fifth aspect of the present invention of the printer according to any of the above-described second to fourth aspects, the guide operating portion is flat plate-shaped, and the width adjustment guiding portion is fixed when the guide operating portion is disposed in an intersecting direction with respect to an extending direction of the slide hole portion.

According to the first aspect, since visibility below the damper portion can be improved, setting of the print medium can be facilitated.

According to the second aspect, turning of the guide operating portion ensures fixing and fixing release of the guide operating portion and the width adjustment guiding portion coupled to it.

According to the third aspect, since turning of the guide operating portion ensures fixing and fixing release of the guide operating portion and the width adjustment guiding portion coupled to it, the position-setting operation of the width adjustment guiding portion can be facilitated.

According to the fourth aspect, since the width adjustment guiding portion below the damper portion can be visually checked, the position-setting operation of the width adjustment guiding portion can be facilitated.

According to the fifth aspect, range where the guide operating portion interrupts with field of view when fixing the width adjustment guiding portion can be reduced.

DESCRIPTION OF EMBODIMENTS

Figure 1:
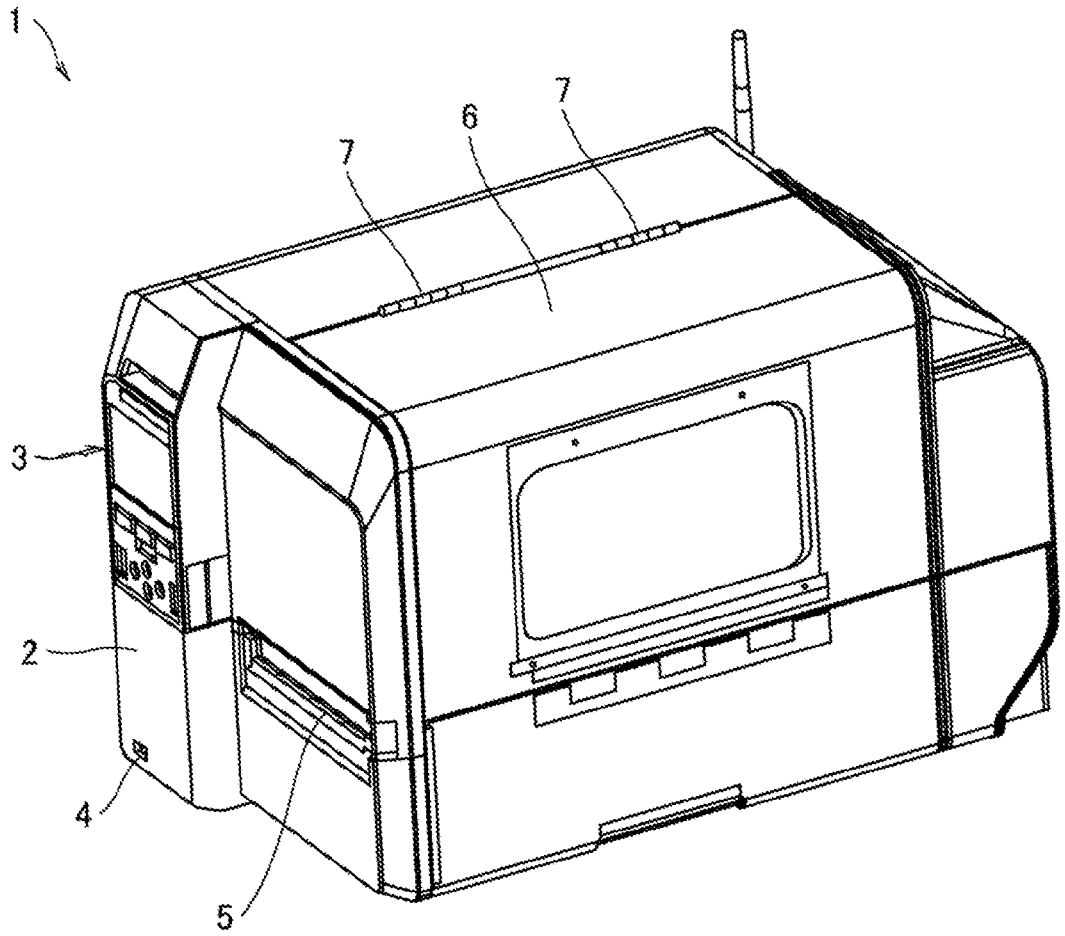
FIG. 1 is an overall perspective view of an appearance of a printer according to one embodiment of the present invention.

The following describes an embodiment as an example of the present invention in detail based on drawings. It should be noted that in the drawings to describe the embodiment, an identical reference numeral is basically attached to an identical component, and its repeated description is omitted.

A feed direction for printing a continuous paper (print medium), specifically a direction feeding the continuous paper from a paper sheet supply unit to a thermal head portion, is referred to as a printing direction, and if there is no specific description, an upstream in the feed direction is referred to as an upstream side in the printing direction, and a downstream in the feed direction is referred to as a downstream side in the printing direction.

FIG. 1 is an overall perspective view of an appearance of a printer according to the embodiment.

A printer 1 according to the embodiment has a label printing function, which prints information such as a character, a sign, a diagram, a barcode, or similar information, for example, on a label adhered temporarily on a liner sheet.

On a front cover portion 2 at a front of the printer 1, an operational panel unit 3, a power switch 4, and an issue port (medium discharge port) 5 are disposed.

On the operational panel unit 3, an LCD (liquid crystal display), which displays a message or similar information, a plurality of keys (line key, feed key, function key, direction indicating key, cancel key, and similar keys), which operate an operation of the printer 1, and a plurality of LEDs (Light Emitting Diodes), which indicate a state of the printer 1, are disposed.

On one side surface of the printer 1, an open cover portion 6 is openably/closably mounted in a vertical direction by hinge portions 7 at two sites.

Figure 2:
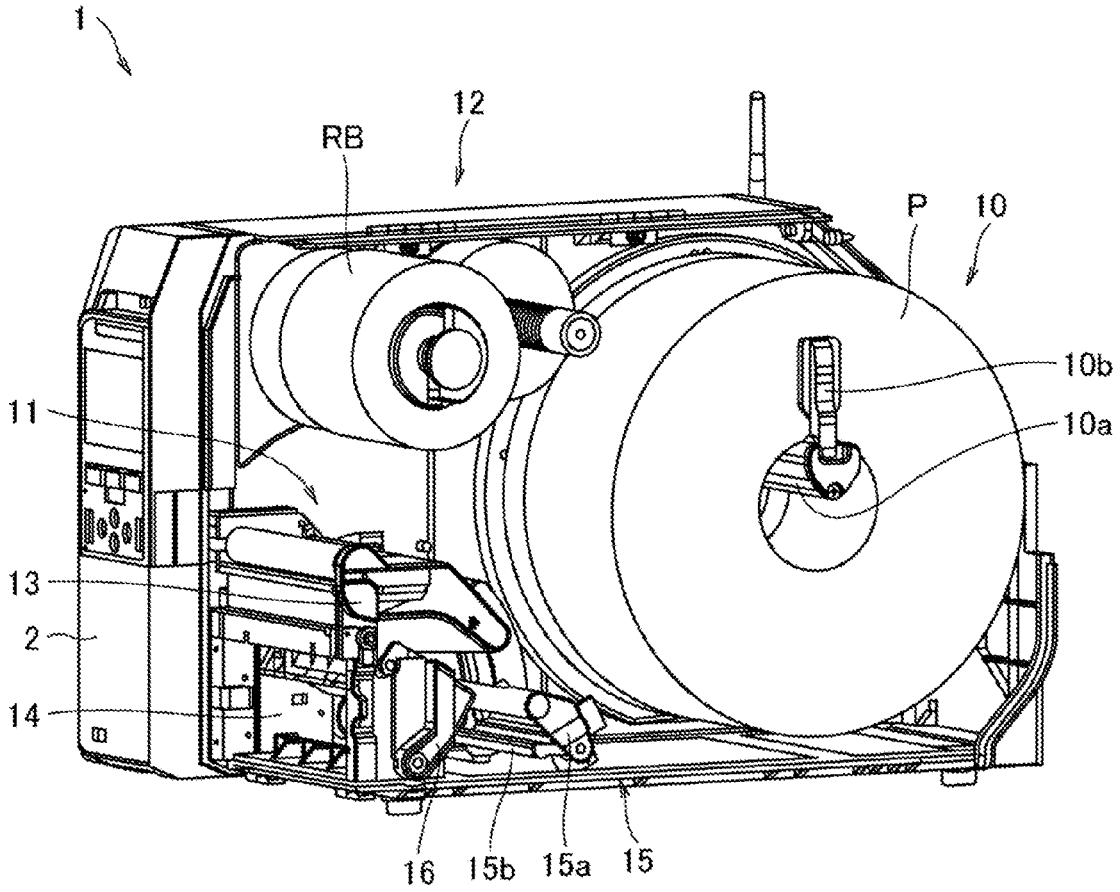
FIG. 2 is a perspective view for illustrating an inside of the printer in FIG. 1.
Figure 3:
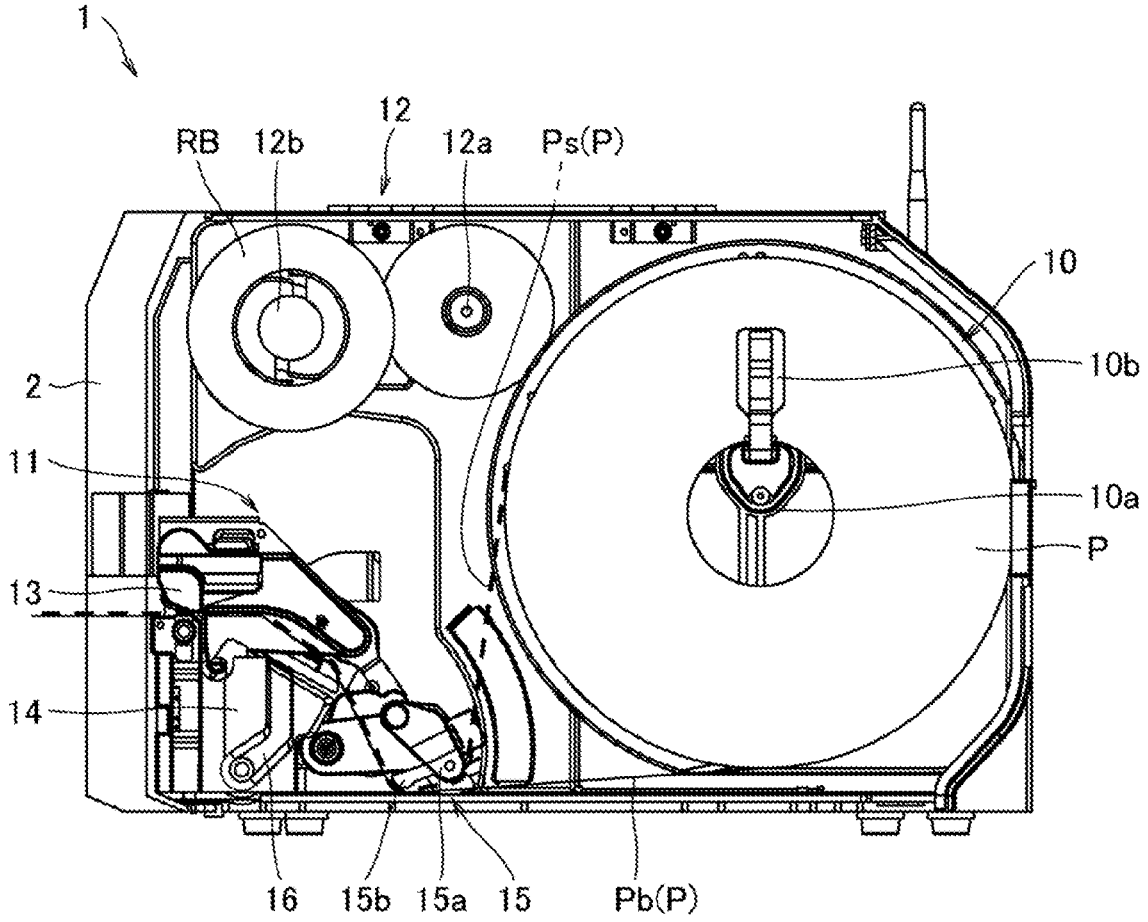
FIG. 3 is a side view of the printer in FIG. 2.

Next, an internal structure of the printer 1 will be described in reference to FIG. 2 and FIG. 3. FIG. 2 is a perspective view for illustrating an inside of the printer in FIG. 1, and FIG. 3 is a side view of the printer in FIG. 2. It should be noted that in the following description, a front side of the printer 1 (front cover portion 2 side) is referred to as a front (at a downstream side in the feed direction of the continuous paper), and its opposite side, a back side (back cover portion side) is referred to as a rear (at an upstream side in the feed direction of the continuous paper).

Inside the printer 1, a paper sheet supply unit (medium supply unit) 10, which is disposed on its rear, a printing unit 11, which is disposed on its front, and an ink ribbon portion 12, which is disposed on its upper side, are installed.

The paper sheet supply unit 10, which is a configuration unit that supplies a continuous paper (print medium) P to the printing unit 11, includes a support shaft 10*a* and a roll guiding portion 10*b*, which is installed at one end of the support shaft 10*a*.

The support shaft 10*a* is a configuration portion that rotatably supports the continuous paper P rolled up in a rolled shape. The roll guiding portion 10*b*, which is a configuration portion that fixes the rolled continuous paper P, is movably installed along an axial direction of the support shaft 10*a* to be able to change its position corresponding to a width of the continuous paper P.

The continuous paper P includes, for example, a long liner sheet and a plurality of labels adhered temporarily at every predetermined interval along a longitudinal direction of the liner sheet. On a surface where an adhesive surface of the label contacts on the liner sheet, a releasing agent such as silicone or similar material is coated, and this ensures the label to be peeled off easily. On a surface where the label is not applied on the liner sheet, position detection marks, which indicate a position of the label, are formed at every predetermined interval along the longitudinal direction. For the label, there is a case where a thermal paper is used and a case where a plain paper is used. In the case of the thermal paper, on its surface, a thermal coloring layer, which develops a specific color (such as black or red) when reaching a predetermined temperature region, is formed.

There are two types of continuous papers P: an outside wound label and an inside wound label. The outside wound label is wound in a state where the label of the continuous paper P is positioned on an outer peripheral surface of the rolled continuous paper P, and as shown in FIG. 3, a continuous paper Ps (P: dashed line) is unwound from around the center in the height direction of the paper sheet supply unit 10 toward a bottom portion of the printing unit 11. In contrast, the inside wound label is wound in a state where the label of the continuous paper P is positioned on an inner peripheral surface side of the rolled continuous paper P, and as shown in FIG. 3, a continuous paper Pb (P: solid line) is unwound from around an internal bottom surface of the printer 1 toward the bottom portion of the printing unit 11. It should be noted that for both outside wound and inside wound, paper passing routes of the continuous paper P (Ps, Pb) in the printing unit 11 are identical. For both outside wound label and inside wound label, the continuous paper P is fed in a state where a surface where the label is temporarily adhered (printed surface) is upward.

The above-described printing unit 11, which is a configuration unit that prints on the label of continuous paper P or a similar print medium, includes a printing head portion 13, a supporting stand 14, which is disposed below the printing head portion 13, and a damper portion 15, which is disposed on a rear (upstream of feed of the continuous paper P at a printing process) of them.

The printing head portion 13 is, as described below, openably/closably installed inside the printer 1. When the printing head portion 13 is in a closed state, between the printing head portion 13 and the supporting stand 14, the paper passing route (medium feed path) is formed. Then, this paper passing route is coupled to the above-described issue port 5 (see FIG. 1).

On the supporting stand 14, a head lock lever portion 16, which maintains the closed state of the printing head portion 13, is installed. Operating this head lock lever portion 16 releases the closed state of the printing head portion 13 and then a front portion of the printing head portion 13 is lifted to open the printing head portion 13 (the printing head portion 13 separates from a platen roller portion 23).

The damper portion 15 is a configuration portion that gives tension to the continuous paper P. According to the embodiment, the damper portion 15, which includes an outer damper portion 15*a* and an inner damper portion 15*b*, moves in the vertical direction (opens and closes) in conjunction with an opening and closing of the printing head portion 13. However, in the closed state of the printing head portion 13, the outer damper portion 15*a* and the inner damper portion 15*b* are swingably installed such that each can give tension to the continuous paper P.

The above-described ink ribbon portion 12, which is a configuration portion that supplies and rolls up an ink ribbon where printing ink is applied, includes a ribbon supply unit 12*a* and a ribbon roll up unit 12*b*, which is disposed on a lateral of a front of the ribbon supply unit 12*a*. The ribbon supply unit 12*a* is a configuration unit that rotatably supports the ink ribbon rolled up in a rolled-shape. The ribbon roll up unit 12*b* is a configuration unit that rolls up and recovers the already printed ink ribbon RB. It should be noted that when using the ink ribbon, the ink ribbon extracted from the ribbon supply unit 12*a* is passed through below the printing head portion 13, and then rolled up by the ribbon roll up unit 12*b*.

According to such printer 1, the continuous paper P (Ps, Pb), which is unwound from the paper sheet supply unit 10 in a sheet-shape, is fed to the paper passing route between the printing head portion 13 and the supporting stand 14 via the damper portion 15, and in the middle of this, a printing processing is executed on the label of the continuous paper P or a similar print medium. After that, the continuous paper P is discharged outside the printer 1 from the issue port 5.

Figure 4A:
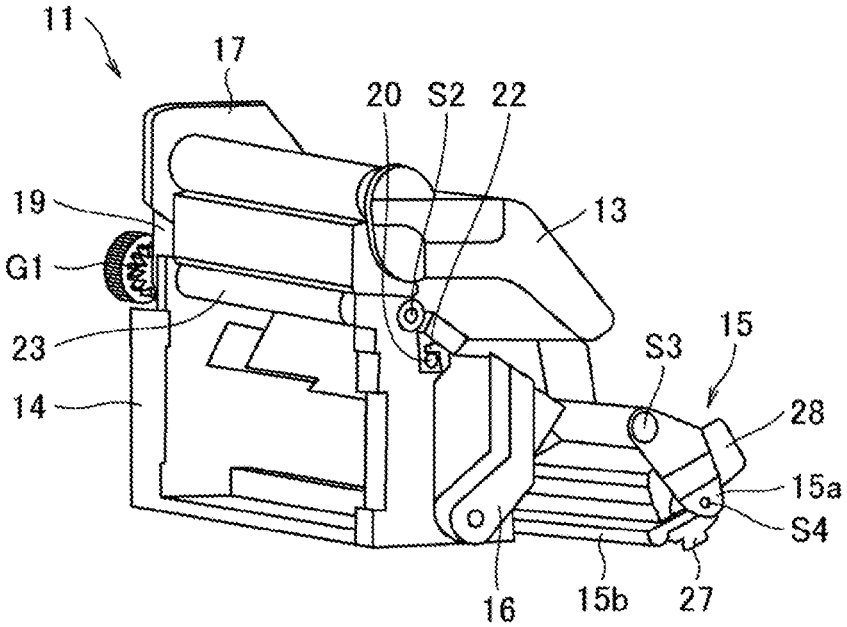
FIG. 4A is an enlarged perspective view where a printing unit in a closed state of a printing head portion in FIG. 3 is viewed from a front.
Figure 4B:
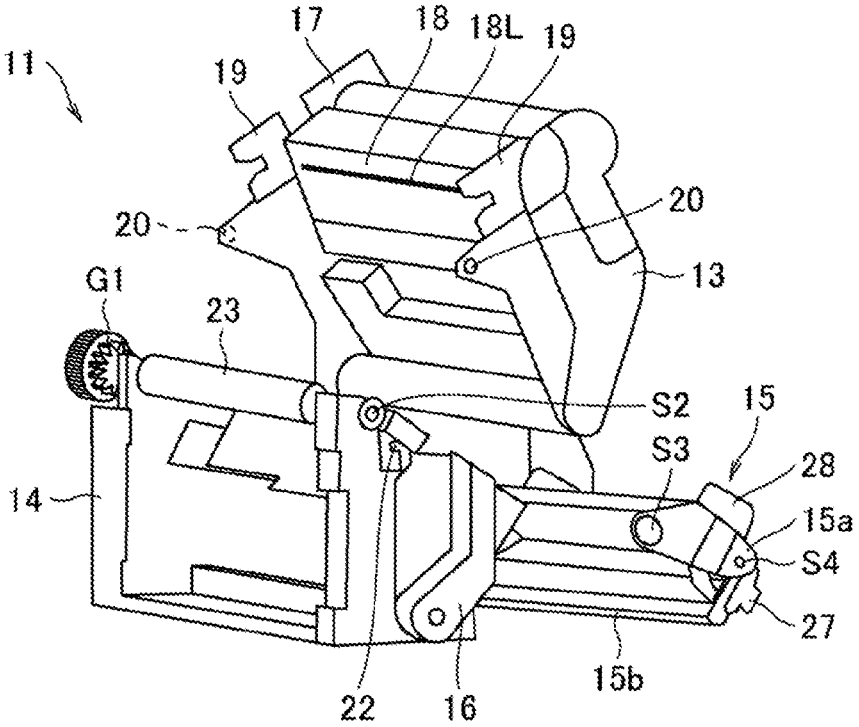
FIG. 4B is an enlarged perspective view where the printing unit in an open state of the printing head portion in FIG. 3 is viewed from the front.
Figure 5:
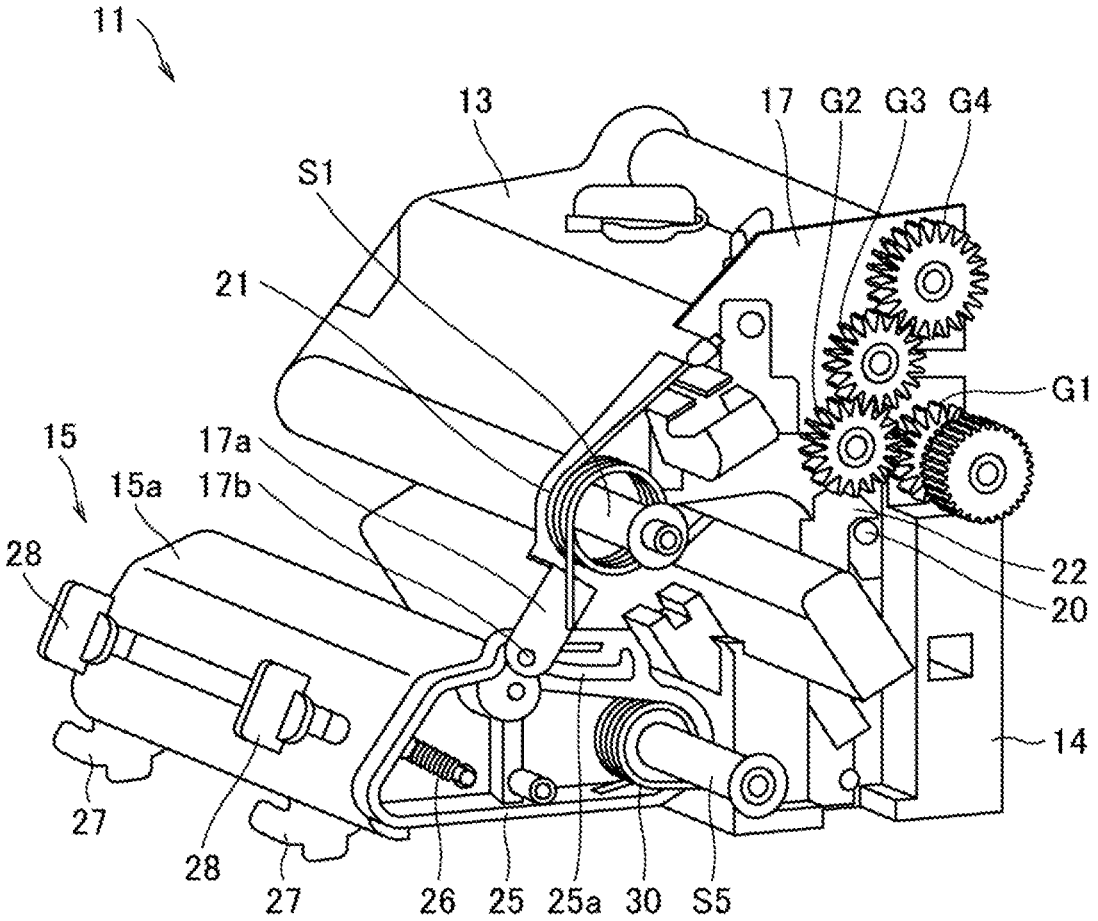
FIG. 5 is an enlarged perspective view where the printing unit in FIG. 4A is viewed from a back side.
Figure 6:
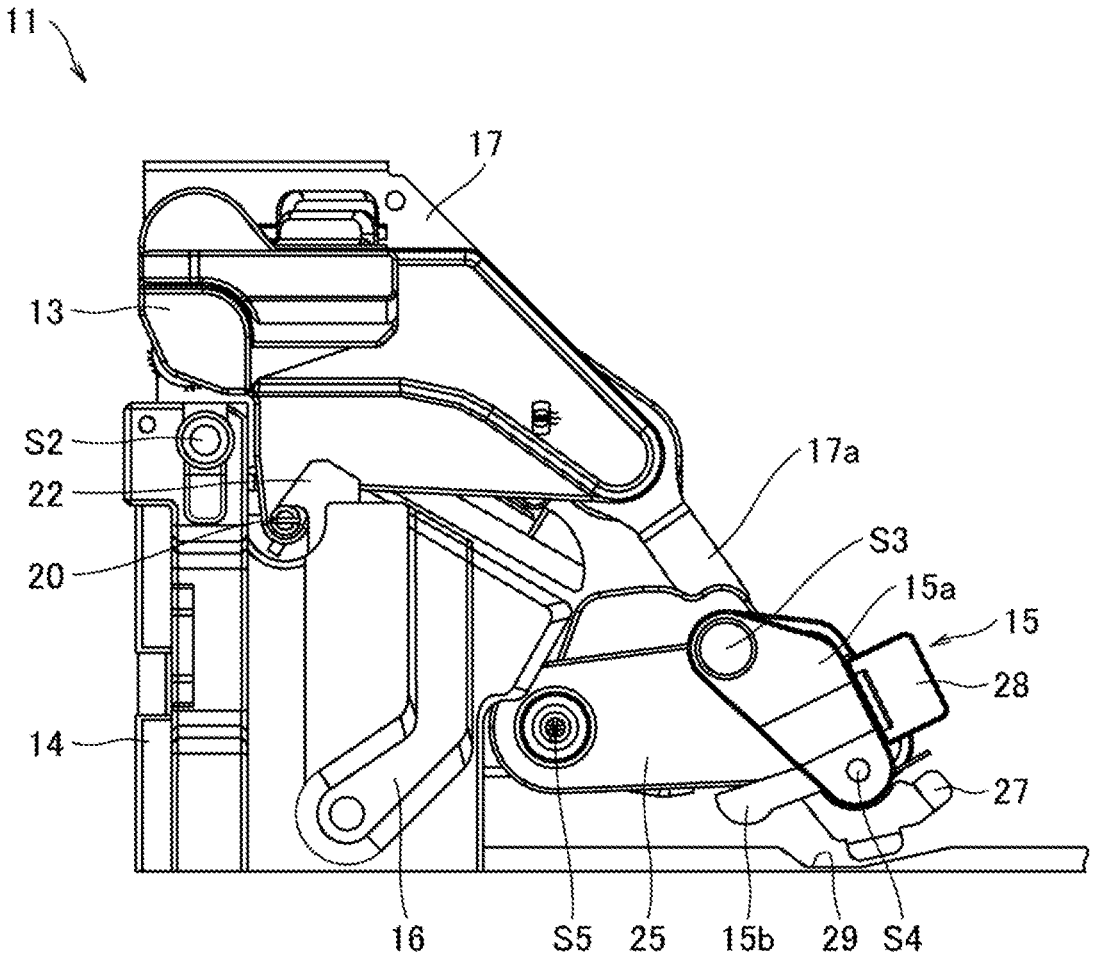
FIG. 6 is an enlarged side view of the printing unit in FIG. 3.
Figure 7:
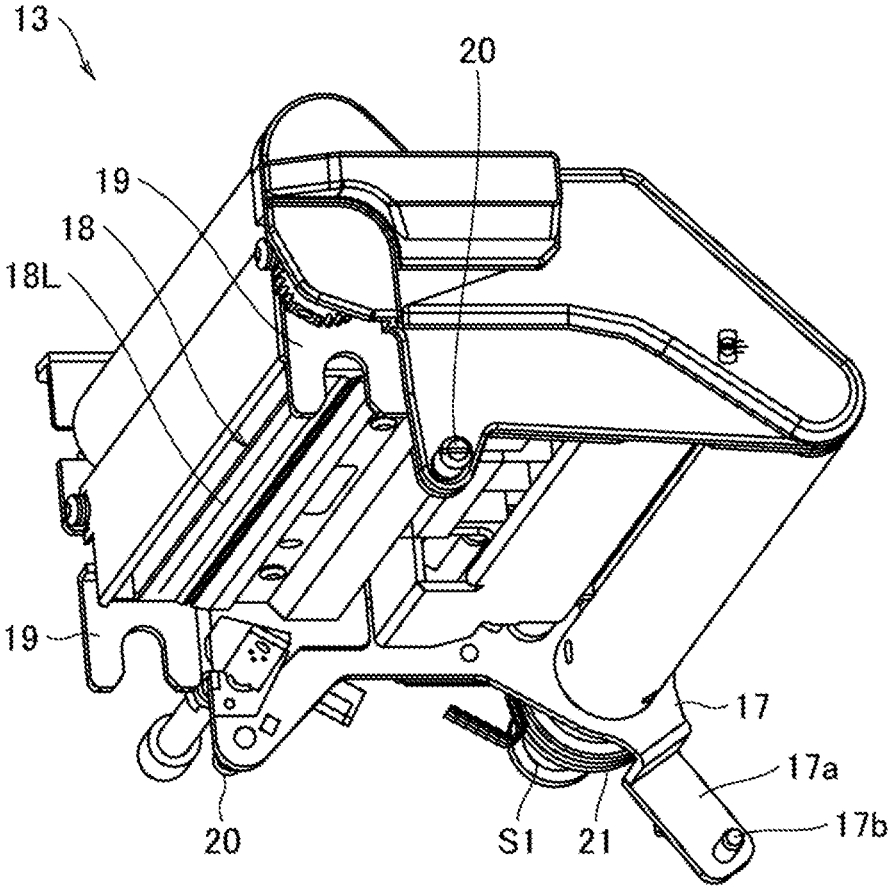
FIG. 7 is a perspective view where a printing head portion in FIG. 6 is extracted and viewed from a lower side.

Next, a configuration of the above-described printing unit 11 will be described in reference to FIG. 4A to FIG. 7. FIG. 4A is an enlarged perspective view where the printing unit in the closed state of the printing head portion in FIG. 3 is viewed from a front. FIG. 4B is an enlarged perspective view where the printing unit in an open state of the printing head portion in FIG. 3 is viewed from the front. FIG. 5 is an enlarged perspective view where the printing unit in FIG. 4A is viewed from a back side. FIG. 6 is an enlarged side view of the printing unit in FIG. 3. FIG. 7 is a perspective view where a printing head portion in FIG. 6 is extracted and viewed from a lower side.

The printing head portion 13 includes the front portion, which is swingably in the vertical direction (that is, openably and closably) supported by a head support plate 17 on one side surface of the printing head portion 13 around a rotary shaft S1 (see FIG. 5 and FIG. 7) which disposed on a rear side of the printing head portion 13.

On an inferior surface (surface facing the paper passing route) of the printing head portion 13, a thermal head portion 18 (see FIG. 4B and FIG. 7) is installed in a state where its printing surface faces the paper passing route. The thermal head portion 18 is printing means, which prints on the label of the continuous paper P and similar print medium with heating resistors of a printing line 18L disposed on a printing surface of the thermal head portion 18. On this printing line 18L, a plurality of heating resistors (heating elements), which generates heat by energization, are arranged along a width direction of the continuous paper P (direction perpendicular to the feed direction of the continuous paper P).

On an inferior surface of a front side of the printing head portion 13, depressed claw portions 19, 19 (see FIG. 4B and FIG. 7) are disposed so as to sandwich the thermal head portion 18. On the inferior surface of the printing head portion 13, pins 20, 20, which project outward from both side surfaces of the printing head portion 13, are disposed on a rear of the depressed claw portion 19.

While such printing head portion 13 is biased in the opening direction by a torsion spring 21 mounted on the rotary shaft S1 (see FIG. 5 and FIG. 7), the printing head portion 13 is maintained to be in a closed state with lock claw portions 22, 22 of the supporting stand 14 being hooked in the pins 20, 20 on a lower portion of the printing head portion 13. Pulling the above-described head lock lever portion 16 rightward in FIG. 6 moves the lock claw portion 22 rightward in FIG. 6 along with this, thus unhooking the lock claw portion 22 from the pin 20. Unhooking the lock claw portion 22 from the pin 20, as shown in FIG. 4B, automatically opens the printing head portion 13 by biasing force of the torsion spring 21.

In the closed state of the printing head portion 13, while a printing surface of the thermal head portion 18 is presses to the platen roller portion 23 (see FIG. 4A and FIG. 4B), which is below the thermal head portion 18, the depressed claw portions 19, 19 (see FIG. 4B and FIG. 7) of the printing head portion 13 are fitted to both end portions of a rotary shaft S2 (see FIG. 4A, FIG. 4B, and FIG. 6) of the platen roller portion 23.

The platen roller portion 23 is feeding means that feeds the continuous paper P unwound from the paper sheet supply unit 10 to the issue port 5 (see FIG. 1) along the paper passing route, and a surface of the platen roller portion 23 is coated with elastic material such as hard rubber. This platen roller portion 23 is rotatably in normal and reverse directions installed on an upper portion of the supporting stand 14. To one end in an axial direction of the rotary shaft S2 of the platen roller portion 23, a gear G1 is coupled. This gear G1, for example, is engaged with a rotary shaft of a driver (not illustrated) such as a stepping motor via such as a timing belt (not illustrated). The gear G1 is coupled to a gear G4 via concatenation gears G2 and G3 (see FIG. 5).

According to the embodiment, on an end portion on the damper portion 15 side on the head support plate 17, which supports the printing head portion 13, a suppression portion 17*a* (see FIG. 5 to FIG. 7) is integrally formed. This suppression portion 17*a* is formed at an opposite end of a front portion of the head support plate 17 with respect to the rotary shaft S1. On a surface facing the damper portion 15 on a distal end of this suppression portion 17*a*, a pin 17*b* (see FIG. 7), which projects from its surface, is disposed. The suppression portion 17*a* and the pin 17*b* are parts of a mechanism, which opens and closes the damper portion 15 in conjunction with an opening and closing of the printing head portion 13. This opening and closing mechanism will be described later in detail.

It should be noted that in the paper passing route of the printing unit 11, between the thermal head portion 18 and the damper portion 15, a paper-sheet-position detecting sensor (not illustrated) is disposed. This paper-sheet-position detecting sensor, which is a sensor that detects a label position of the continuous paper P by detecting the position detection mark disposed on the continuous paper P or a liner sheet part between adjacent labels, for example, is constituted of a light reflection type or light transmission type sensor.

At the printing process, the continuous paper P is fed by rotating the platen roller portion 23 in a state where the continuous paper is sandwiched between the thermal head portion 18 and the platen roller portion 23. Then, based on information detected by the paper-sheet-position detecting sensor, a printing timing is determined, and the heating resistors of the printing line 18L are selectively heated by a printing signal transmitted to the thermal head portion 18. Thus, desired information, such as a character, a sign, a diagram, a barcode, or similar information, is printed on the label of the continuous paper P.

On the other hand, the outer damper portion 15*a* of the damper portion 15, when viewing a side surface of the printing unit 11, extends obliquely downward from a front side to a rear side, and is supported by a damper supporting member 25 around a rotary shaft S3 of the front side (see FIG. 4A, FIG. 4B and FIG. 6) in a state where the rear portion is swingable in the vertical direction. It should be noted that a coil spring 26 in FIG. 5, as described later, is a member that inhibits the outer damper portion 15*a* from going excessively to an upper side (rear side), and swingably supports the outer damper portion 15*a*.

The inner damper portion 15*b* of the damper portion 15, when viewing the side surface of the printing unit 11, extends obliquely downward from the rear side to the front side in contrast to the outer damper portion 15*a*, and is supported by the rear portion of the outer damper portion 15*a* around a rotary shaft S4 (see FIG. 4A, FIG. 4B and FIG. 6) on the rear side in a state where a front portion is swingable in the vertical direction.

At the printing process, a paper sheet contact portion of the inner damper portion 15*b* is positioned on a downstream of feed of the continuous paper P with respect to a paper sheet contact portion of the outer damper portion 15*a*. That is, the paper sheet contact portion of the inner damper portion 15*b* is disposed between the printing head portion 13 and the paper sheet contact portion of the outer damper portion 15*a*.

At a phase before passing through the paper, a height of the paper sheet contact portion of the inner damper portion 15*b* is disposed at a lower position than a height of the paper sheet contact portion of the outer damper portion 15*a*. That is, the height of the paper sheet contact portion of the inner damper portion 15*b* is disposed between the paper sheet contact portion of the outer damper portion 15*a* and a bottom surface inside the printer 1. It should be noted that configurations of the outer damper portion 15*a* and the inner damper portion 15*b* will be described later in detail.

On a lower portion of the outer damper portion 15*a*, a width adjustment guiding portion 27 is movably installed along an axial direction of the rotary shafts S3 and S4. The width adjustment guiding portion 27 is a configuration portion that abuts on an end portion of the width direction of the continuous paper P fed from the paper sheet supply unit 10, and guides the feed of the continuous paper P. This width adjustment guiding portion 27 is coupled to the guide operating portion 28 on a back side of the outer damper portion 15*a*. This guide operating portion 28 is a tab for, while moving the width adjustment guiding portion 27 according to the width of the continuous paper P, fixing a position of the width adjustment guiding portion 27.

According to the embodiment, on the bottom surface inside the printer 1 below the damper portion 15, a depression portion 29 (see FIG. 6) is partially formed. The depression portion 29 is formed in closed states of the printing head portion 13 and the damper portion 15, so that a lower portion of the width adjustment guiding portion 27 is positioned below the bottom surface inside the printer 1. The width adjustment guiding portion 27 includes a lower end portion, which is, as shown in FIG. 5 or similar drawings, positioned within the depression portion 29, but does not contact a bottom surface of the depression portion 29, and is away from the bottom surface of the depression portion 29 at only a predetermined distance. This lower end portion of the width adjustment guiding portion 27 may be formed, for example, in an arc-shape. This depression portion 29 will be also described later in detail.

A damper supporting member 25, which supports the outer damper portion 15*a* of such damper portion 15, is supported within the printer 1 around of a rotary shaft S5

(see FIG. 5 and FIG. 6) on a front portion side in a state where a rear portion is swingable in a vertical direction.

On an upper portion of this damper supporting member 25, a long groove portion (induction portion) 25*a* (see FIG. 5), which extends along a longitudinal direction of the damper supporting member 25, is formed. To this long groove portion 25*a*, the pin 17*b* (see FIG. 8) of the above-described head support plate 17 is movably fitted along the long groove portion 25*a*. Thus, the head support plate 17, which supports the printing head portion 13, is engaged with the damper supporting member 25.

The damper supporting member 25 includes the rear portion, which while being biased in a direction opening above (direction where the entire damper portion 15 rises) around the rotary shaft S5 (see FIG. 5 and FIG. 6) by a torsion spring 30 (see FIG. 5) mounted on the rotary shaft S5, is suppressed by the suppression portion 17*a* while the suppression portion 17*a* of the head support plate 17 is positioned on a side of the outer damper portion 15*a*, and maintained in a closed state.

Figure 8:
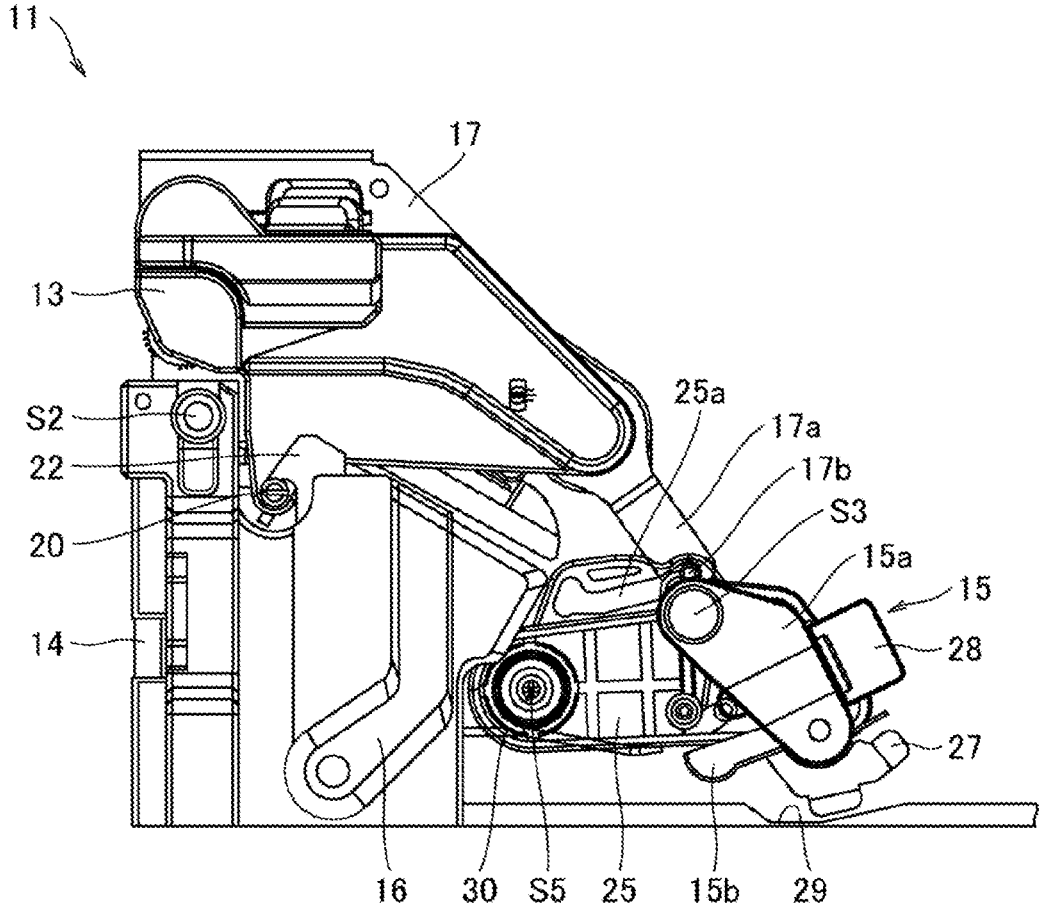
FIG. 8 is an enlarged side view of the printing unit in the closed state of the printing head portion.
Figure 9:
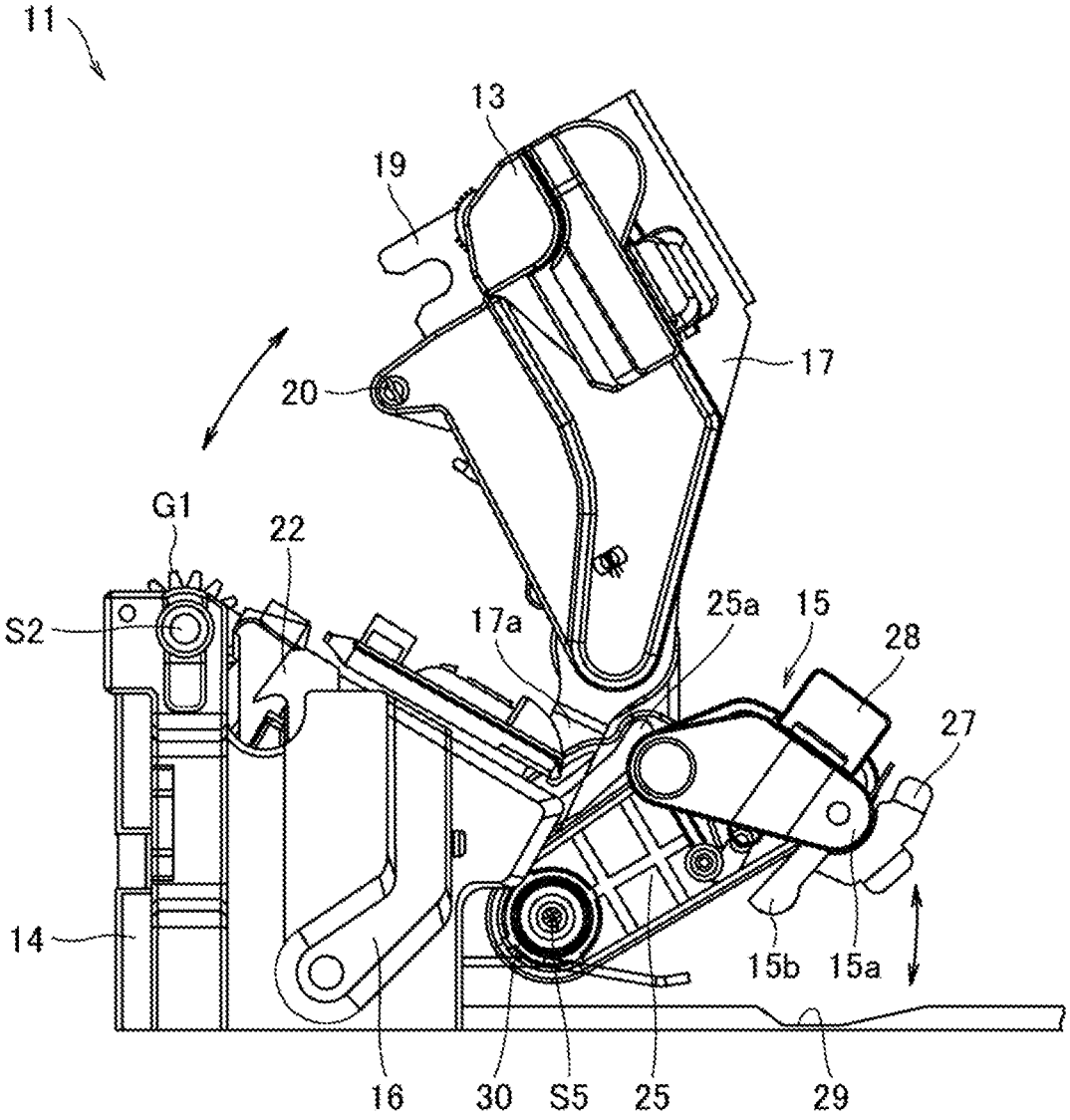
FIG. 9 is an enlarged side view of the printing unit in the open state of the printing head portion.

Next, an opening and closing operations of the damper portion 15 will be described in reference to FIG. 8 and FIG. 9. FIG. 8 is an enlarged side view of the printing unit in the closed state of the printing head portion, and FIG. 9 is an enlarged side view of the printing unit in the open state of the printing head portion. It should be noted that, in FIG. 8 and FIG. 9, a backside surface of the damper supporting member 25 is shown through.

According to the embodiment, as shown in FIG. 8 and FIG. 9, the damper portion 15 moves in a vertical direction (opens and closes) in conjunction with the opening and closing operations of the printing head portion 13. That is, when a height of a reference position of the damper portion 15 in the closed state of the printing head portion 13 is a first height, if the printing head portion 13 opens, in conjunction with this, the height of the reference position of the damper portion 15 moves to a second height, which is higher than the first height, and conversely if the printing head portion 13 closes, in conjunction with this, the height of the reference position of the damper portion 15 returns to the first height.

When opening the printing head portion 13 and passing the continuous paper P through the paper passing route as a preparing phase for a printing operation, if the damper portion 15 remains to be fixed, since the damper portion 15 is installed at a proximity of a bottom surface of a chassis of the printer 1, the continuous paper P extracted from the paper sheet supply unit 10 has to be passed through below the damper portion 15 at the proximity of the bottom surface of the chassis where an operation is difficult. Since a gap between the damper portion 15 and the bottom surface of the chassis of the printer 1 is narrow, passing the continuous paper P is difficult. Furthermore, since on a lower portion of the damper portion 15, the width adjustment guiding portion 27 is mounted, when inserting the continuous paper P, the continuous paper P may be hooked on the width adjustment guiding portion 27. By these reason, there is a problem that an operation inserting the continuous paper P into the paper passing route of the printer 1 is difficult. In contrast, according to the embodiment, since opening the printing head portion 13 causes the damper portion 15 to rise, a width inserting the continuous paper P is enlarged to improve visibility of the lower portion of the damper portion 15. This, without hooking the continuous paper P extracted from the paper sheet supply unit 10 on the width adjustment guiding portion 27, can easily pass the continuous paper P through below the damper portion 15. Accordingly, the operation inserting the continuous paper P into the paper passing route of the printer 1 can be facilitated.

Although there is a case disposing another mechanism opening the damper portion 15 manually, in this case, a trouble may occur such that since the printing head portion 13 has been closed with failing to close the damper portion 15, printing is executed in a state where enough tension is not gave to the continuous paper P. In contrast, according to the embodiment, closing the printing head portion 13 causes the damper portion 15 to decreased to return to the original first height. That is, since this can prevent the damper portion 15 from being failed to close, the trouble that printing is executed in a state where tension is not gave to the continuous paper P can be prevented. A sequence of inserting operation of the continuous paper P can be simplified.

Figure 10:
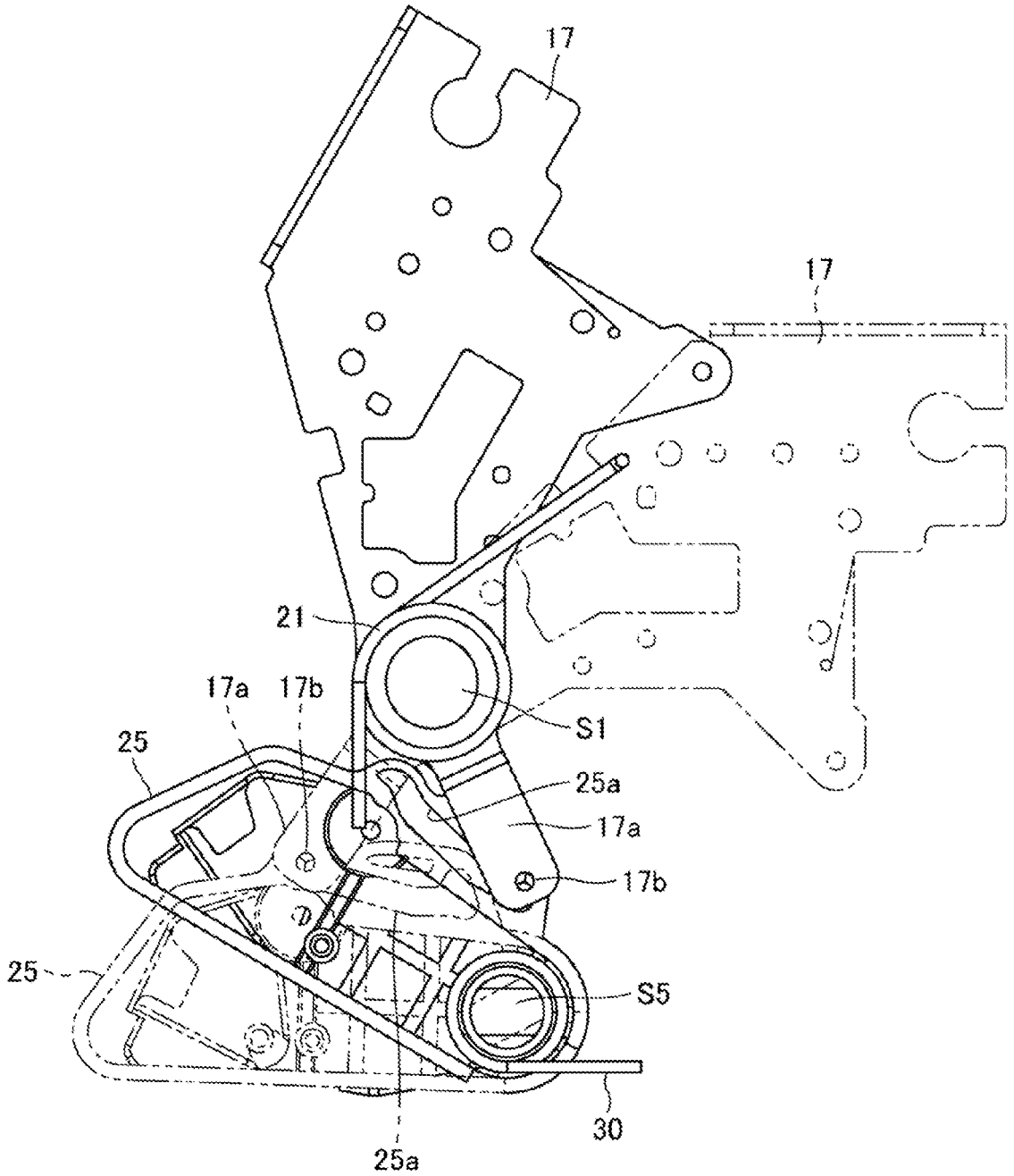
FIG. 10 is a side view that extracts and illustrates a head support plate and a damper supporting member in the open/closed state of the printing head portion.
Figure 11A:
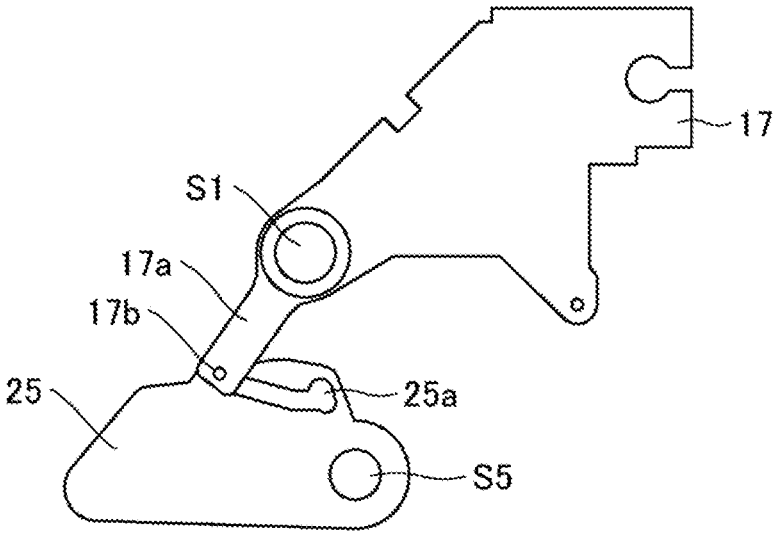
FIG. 11A is a side view of the head support plate and the damper supporting member in the closed state of the printing head portion in FIG. 10.
Figure 11B:
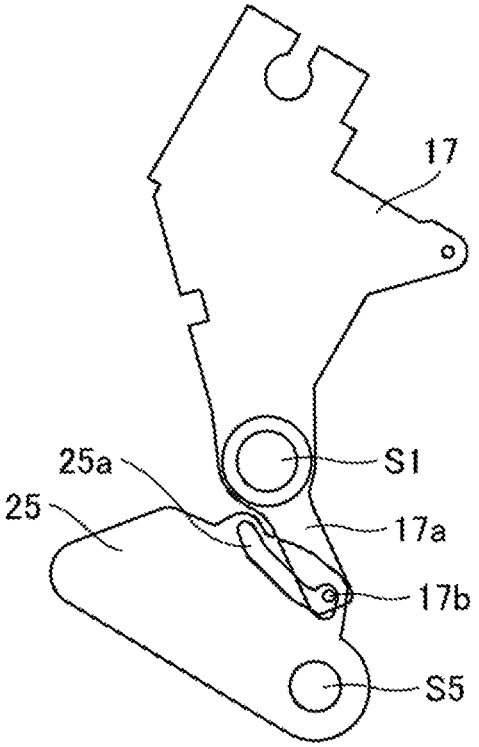
FIG. 11B is a side view of the head support plate and the damper supporting member in the open state of the printing head portion in FIG. 10.

Next, a coupled mechanism of the printing head portion 13 and the damper portion 15 will be described in reference to FIG. 8 to FIG. 11B. FIG. 10 is a side view that extracts and illustrates the head support plate and the damper supporting member in an open and closed state of the printing head portion. FIG. 11A is a side view of the head support plate and the damper supporting member in the closed state of the printing head portion in FIG. 10. FIG. 11B is a side view of the head support plate and the damper supporting member in the open state of the printing head portion in FIG. 10. It should be noted that, in FIG. 10, a two-dot chain line illustrates the head support plate 17 and the damper supporting member 25 in a closed state. FIG. 10, FIG. 11A, and FIG. 11B illustrate the side surface of the printing unit 11 shown in FIG. 5.

As shown a two-dot chain line in FIG. 10, and FIG. 11A, a rear portion of the damper supporting member 25 (left side in FIG. 10, FIG. 11A, and FIG. 11B) is biased in a direction opening above by biasing force of the torsion spring 30 (see FIG. 10) (direction separating from the bottom surface inside the printer 1). On the other hand, in the closed state of the head support plate 17 (printing head portion 13), the suppression portion 17*a* of the head support plate 17 suppresses a suppression position on a rear portion side of the damper supporting member 25 (side where the outer damper portion 15*a* is arranged). Thus, an opening of the damper supporting member 25 is prevented, and as shown in FIG. 8, the damper portion 15 also closes.

Here, as shown a solid line in FIG. 10, and FIG. 11B, if the front portion of the head support plate 17 (printing head portion 13) (right side part in FIG. 10, FIG. 11A, and FIG. 11B) is opened above (direction separating from the platen roller portion 23), because the head support plate 17 rotates around the rotary shaft S1, the suppression portion 17*a*, which is positioned an opposite end of the front portion of the head support plate 17, moves in an opposite direction of a moving direction of the front portion of the head support plate 17. That is, the pin 17*b* of the suppression portion 17*a* separates from the suppression position on one end side of the long groove portion 25*a* of the damper supporting member 25, and then moves automatically to a suppression release position of the other end side of the long groove portion 25*a* along the long groove portion 25*a*. Thus, since the rear portion of the damper supporting member 25 is rose automatically by the biasing force of the torsion spring 30, in accordance with this, as shown in FIG. 9, the damper portion 15 is also rose automatically to open (separates from the bottom surface inside the printer 1). In this case, since the damper portion 15 is gradually rose as the pin 17*b* of the suppression portion 17*a* moves from the suppression position to the suppression release position along the long groove portion 25*a*, an occurrence of unpleasant sound, which occurs when the damper portion 15 opens rapidly, can be suppressed or prevented.

On the other hand, if the front portion of the head support plate 17 (printing head portion 13) closes downward (direction closing to the platen roller portion 23), the suppression portion 17*a* of the head support plate 17 moves in an opposite direction of the moving direction of the front portion of the head support plate 17. That is, the pin 17*b* of the suppression portion 17*a* separates from the suppression release position of the other end side of the long groove portion 25*a* of the damper supporting member 25, and then returns automatically to the suppression position of the one end side of the long groove portion 25*a* along the long groove portion 25*a*. Thus, since the rear portion of the damper supporting member 25 is decreased against the biasing force of the torsion spring 30, in accordance with this, as shown in FIG. 8, the damper portion 15 is also decreased automatically to close (closes to the bottom surface inside the printer 1).

The opening and closing mechanism of the damper portion 15 is not limited to the above-described configuration, but, for example, may be as follows. That is, the rear portion of the damper supporting member 25 may be biased in a direction closing around the rotary shaft S5 by the torsion spring 30 mounted on the rotary shaft S5 (direction where the entire damper portion 15 is decreased). In this case, if the printing head portion 13 opens, as the suppression portion 17*a* moves from the suppression position to the suppression release position along the long groove portion 25*a*, the rear portion of the damper supporting member 25 is pulled to rise. Thus, the rear portion of the damper portion 15 opens in conjunction with an opening operation of the printing head portion 13. On the other hand, if the printing head portion 13 closes, as the suppression portion 17*a* moves from the suppression release position to the suppression position along the long groove portion 25*a*, the rear portion of the damper supporting member 25 is decreased by an action of the torsion spring 30. Thus, the rear portion of the damper portion 15 closes in conjunction with a closing operation of the printing head portion 13. In this case, the biasing force of the torsion spring 21 on a side of the printing head portion 13 is configured to be larger than the biasing force of the torsion spring 30 on a side of the damper supporting member 25.

As described above, when disposing another mechanism portion opening the damper portion 15 manually, there is a problem that, since a structure is complicated, and the number of components increases, a cost of the printer 1 increases, and a downsizing of the printer 1 is inhibited. In contrast, according to the embodiment, since the other mechanism portion opening the damper portion 15 manually is not disposed, and an opening mechanism portion and a closing mechanism portion of the damper portion 15 are double as one another, the structure can be simplified, and the number of components can be reduced. In view of this, the cost of the printer 1 can be reduced, and the downsizing of the printer 1 can be proceeded.

Figure 12:
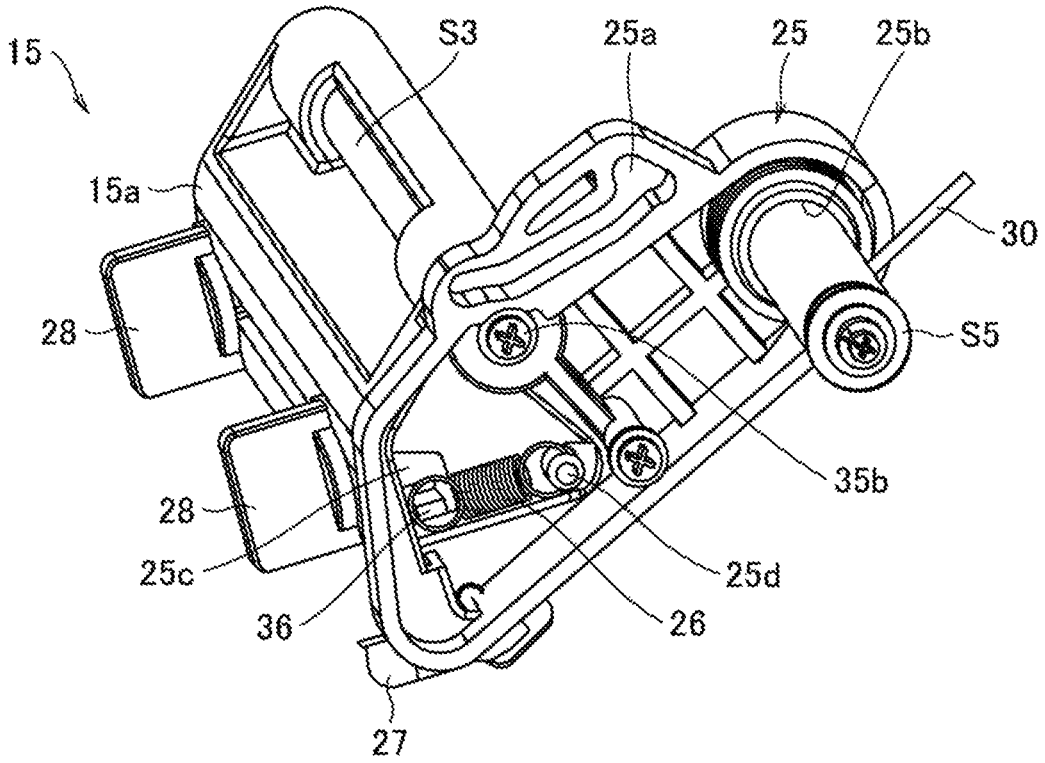
FIG. 12 is a perspective view of the damper portion and the damper supporting member viewed from the side surface of the printing unit in FIG. 5.
Figure 13:
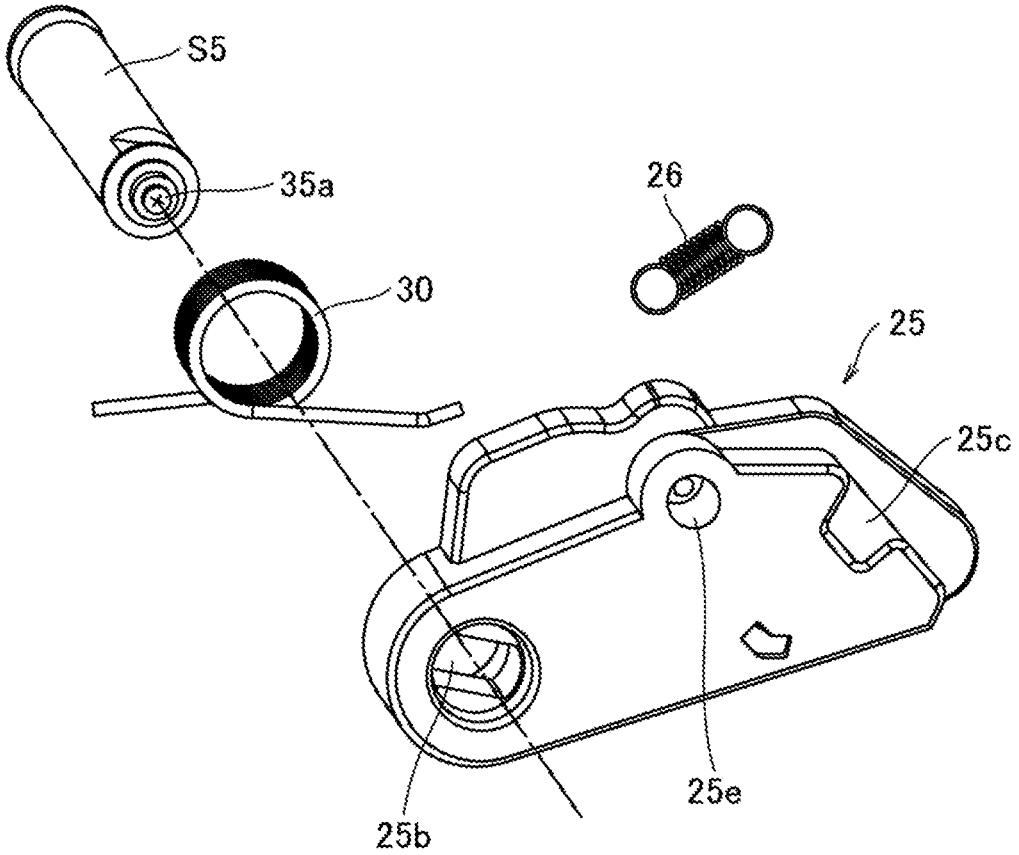
FIG. 13 is an exploded perspective view of the damper supporting member viewed from a side where the damper portion is mounted.
Figure 14A:
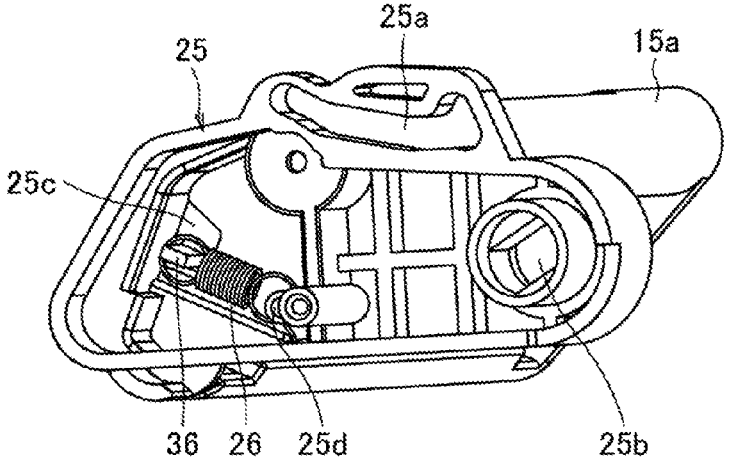
FIG. 14A is a perspective view for illustrating a coupling portion of an outer damper portion and the damper supporting member in FIG. 12.
Figure 14B:
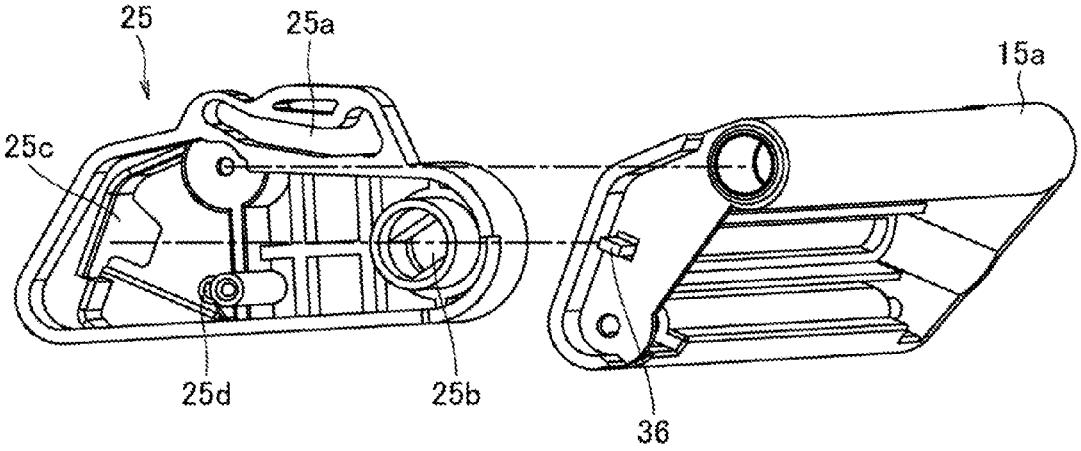
FIG. 14B is an exploded perspective view for illustrating a positional relationship to couple the outer damper portion and the damper supporting member in FIG. 14A.

Next, a configuration of the damper supporting member 25 and a coupling relationship with the damper portion 15 and the damper supporting member 25 will be described in reference to FIG. 12 to FIG. 14B. FIG. 12 is a perspective view of the damper portion and the damper supporting member viewed from a side surface side of the printing unit in FIG. 5. FIG. 13 is an exploded perspective view of the damper supporting member viewed from a side where the damper portion is mounted. FIG. 14A is a perspective view for illustrating a coupling portion of the outer damper portion and the damper supporting member in FIG. 12. FIG. 14B is an exploded perspective view for illustrating a positional relationship to couple the outer damper portion to the damper supporting member in FIG. 14A. It should be noted that, on both side surfaces of the damper supporting member 25, a side surface facing the outer damper portion 15*a* is referred to as an internal surface, and a side surface of its back side is referred to as an outer surface.

On one end side in the longitudinal direction of the damper supporting member 25, a bearing hole portion 25*b*, which passes through both side surfaces of the damper supporting member 25, is formed. Into this bearing hole portion 25*b*, the rotary shaft S5 is inserted in a fixed state not to rotate, and screwed by a screw 35*a* (see FIG. 13) not to remove. It should be noted that the torsion spring 30 is mounted in a state where its ring is fitted to the rotary shaft S5.

On the other end side in the longitudinal direction of the damper supporting member 25, a hole portion 25*c*, which passes through between both side surfaces of the damper supporting member 25, is formed. In this hole portion 25*c*, a protrusion 36, which is formed on a side surface of the outer damper portion 15*a*, is projected. The hole portion 25*c* is formed so that a margin at predetermined dimensions is generated around the protrusion 36.

The outer surface of the damper supporting member 25 is formed to be depressed in a thickness direction. On this outer surface of the damper supporting member 25, at a proximity of the hole portion 25*c*, a protrusion 25*d* is formed. Between this protrusion 25*d* of the damper supporting member 25 and the protrusion 36 of the outer damper portion 15*a*, the coil spring 26 is installed to be bridged. This coil spring 26 is biased to pull the protrusion 36 of the outer damper portion 15*a* in a direction of the protrusion 25*d* of the damper supporting member 25. Thus, the outer damper portion 15*a*, while being firmly supported along an axial direction of the rotary shaft S3 and suppressed not to go excessively to an upper side, is swingably supported so as to give tension to the continuous paper P.

Furthermore, on a upper portion of the internal surface of the damper supporting member 25, at a proximity of a center in a longitudinal direction, a bearing hole portion 25*e* (see FIG. 13) is formed. Into this bearing hole portion 25*e*, the rotary shaft S3 of the outer damper portion 15*a* is inserted in a fixed state not to rotate, and screwed by a screw 35*b* (see FIG. 12) not to remove.

Figure 15A:
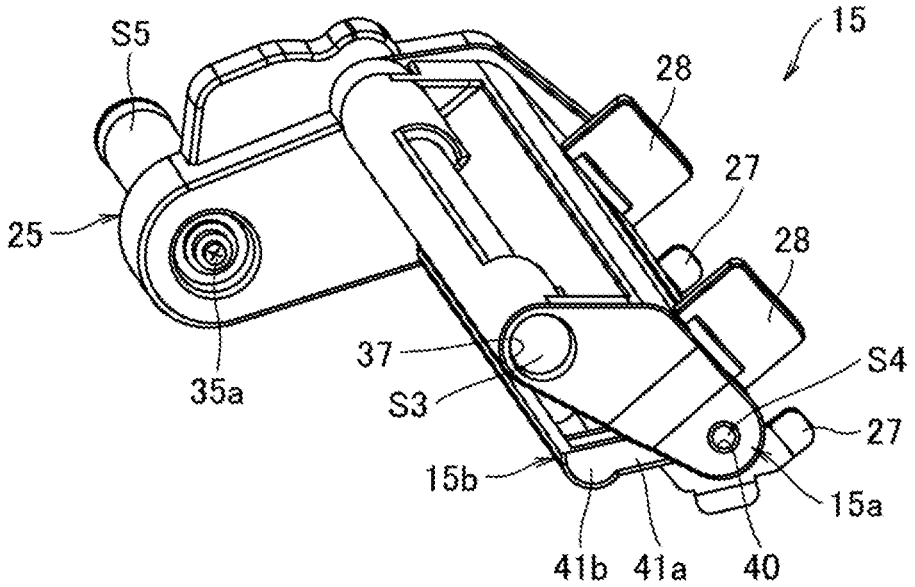
FIG. 15A is a perspective view where the damper portion and the damper supporting member are viewed from obliquely above.
Figure 15B:
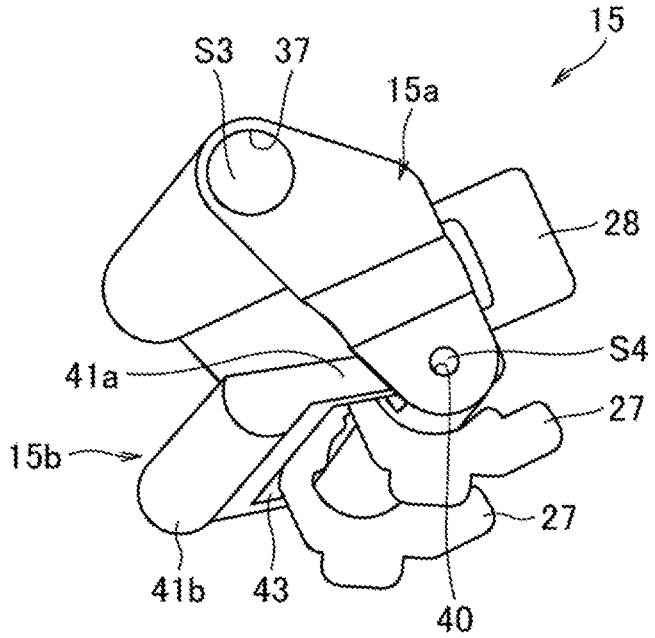
FIG. 15B is a perspective view where the damper portion is viewed from obliquely below.
Figure 16:
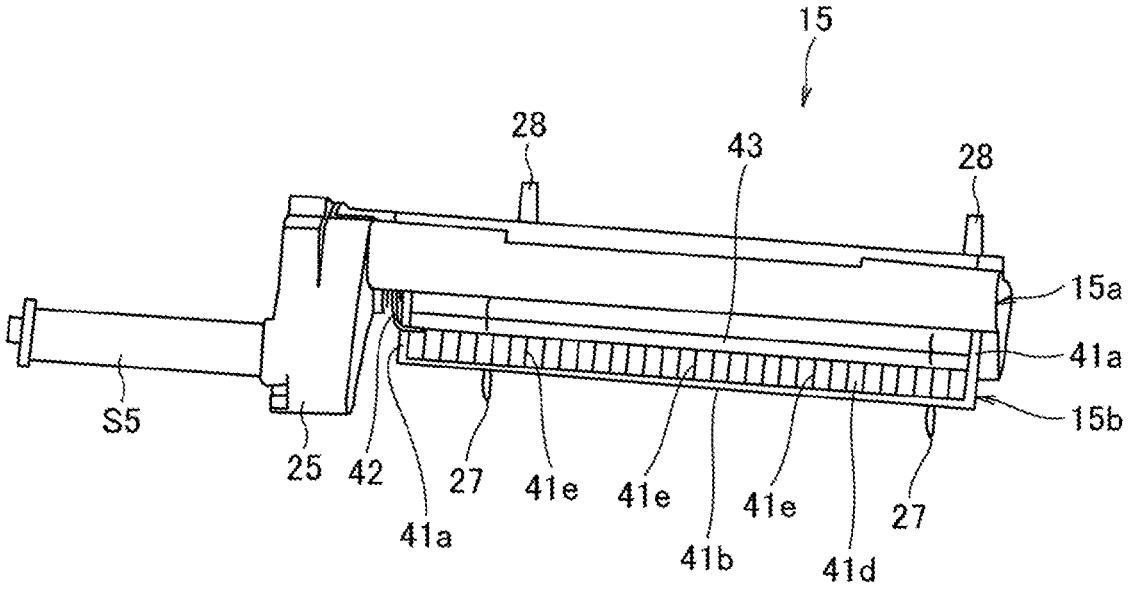
FIG. 16 is a perspective view where the damper portion and the damper supporting member are viewed from above.
Figure 17:
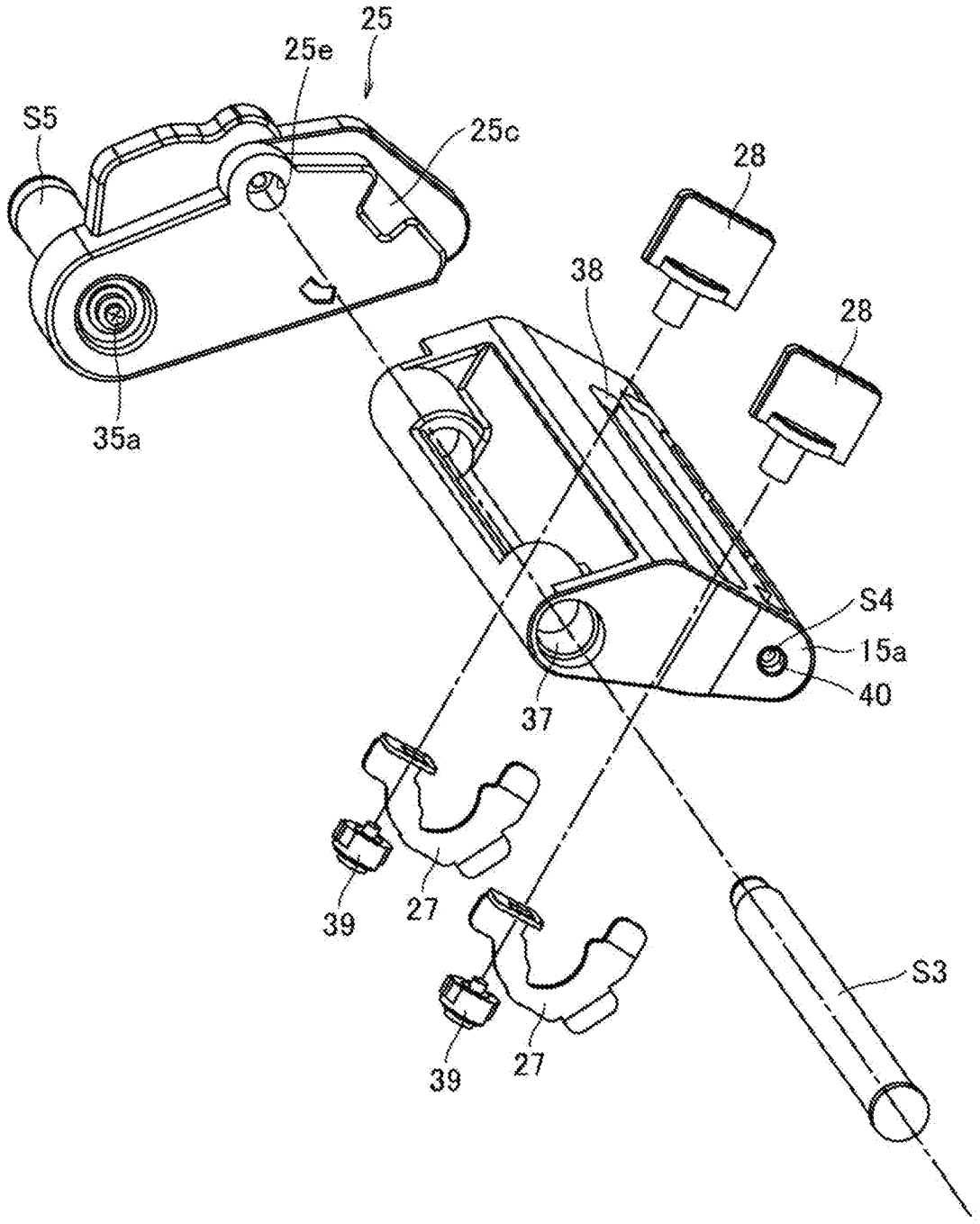
FIG. 17 is an exploded perspective view of the outer damper portion.
Figure 18:
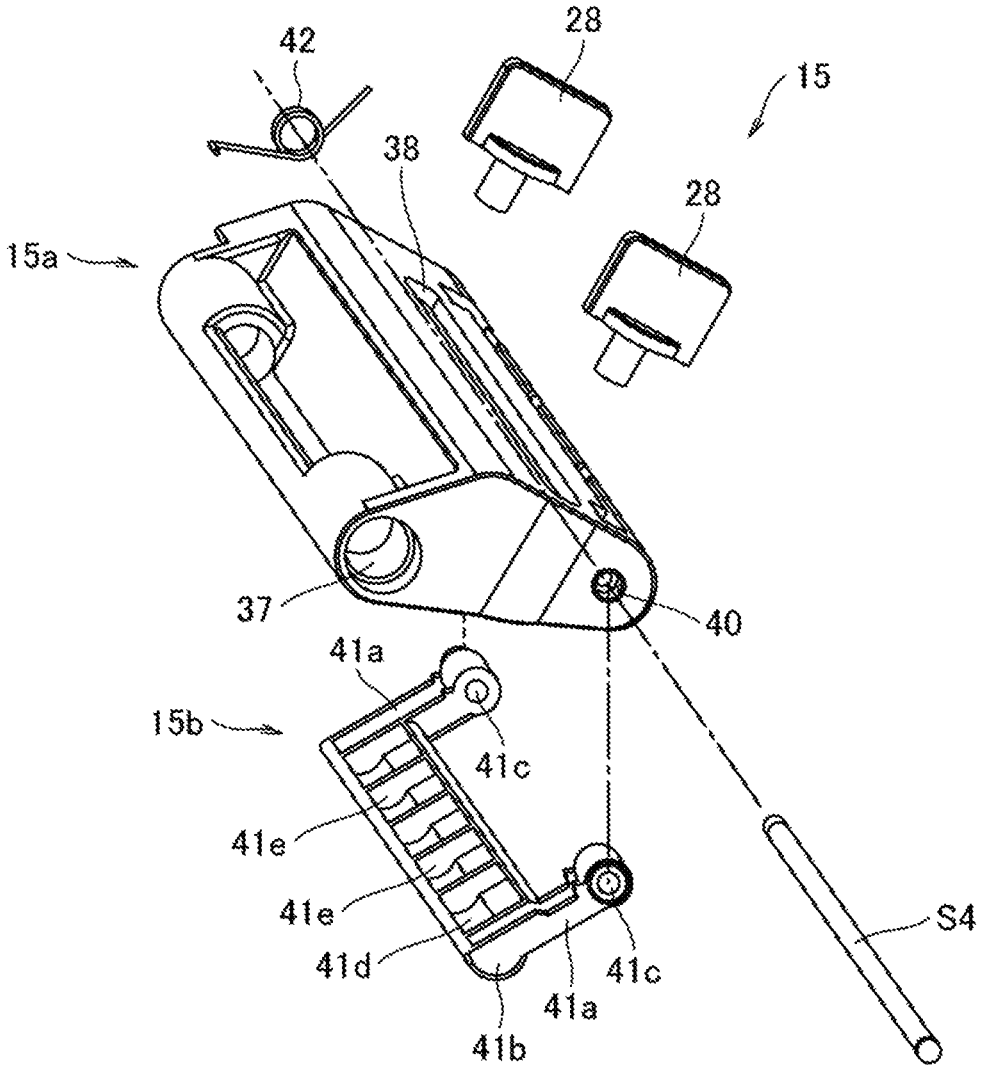
FIG. 18 is an exploded perspective view of the outer damper portion and the inner damper portion.

Next, a configuration of the damper portion 15 will be described in reference to FIG. 15A to FIG. 18. FIG. 15A is a perspective view where the damper portion and the damper supporting member are viewed from obliquely above. FIG. 15B is a perspective view where the damper portion is viewed from obliquely below. FIG. 16 is a perspective view where the damper portion and the damper supporting member are viewed from above. FIG. 17 is an exploded perspective view of the outer damper portion. FIG. 18 is an exploded perspective view of the outer damper portion and the inner damper portion.

On one end side (upper end portion side) in the longitudinal direction where the outer damper portion 15*a* is viewed from the side surface, a bearing hole portion 37 is formed. Into this bearing hole portion 37, the rotary shaft S3 is inserted. Thus, the outer damper portion 15*a* is rotatably journaled around the rotary shaft S3. That is, the outer damper portion 15*a* is swingably journaled in a vertical direction around the rotary shaft S3 so that its other end part (lower end portion) in the longitudinal direction can give tension to the continuous paper P.

On a back surface of the outer damper portion 15*a*, a slide hole portion 38 is formed along the axial direction of the rotary shaft S3, that is, the longitudinal direction of the outer damper portion 15*a*. Into this slide hole portion 38, for example, shaft portions of the two guide operating portions 28 are inserted. To this shaft portion of the guide operating portion 28, the width adjustment guiding portion 27 is coupled such that the width adjustment guiding portion 27 is sandwiched between this shaft portion and a pin 39 (see FIG. 17), which constitutes a part of the guide operating portion 28. The width adjustment guiding portion 27 is positioned on an inferior surface of the outer damper portion 15*a*.

The guide operating portion 28 is turnably coupled to the width adjustment guiding portion 27. Then, this turning position of the guide operating portion 28 causes moving position in the slide hole portion 38 of the guide operating portion 28 and the width adjustment guiding portion 27 to be fixed or to be fix-released.

Here, for example, the guide operating portion 28 on a far-side and the width adjustment guiding portion 27 coupled to it are fixed. The guide operating portion 28 on a near-side and the width adjustment guiding portion 27 coupled to it, while being movable along the slide hole portion 38, can be fixed according to the width of the continuous paper P. However, the guide operating portion 28 and the width adjustment guiding portion 27 each may be one. It should be noted that the width adjustment guiding portion 27 and the guide operating portion 28 will be described later in detail.

The paper sheet contact portion, where the continuous paper P contacts, on the other end side (lower end portion side) in the longitudinal direction where the outer damper portion 15*a* is viewed from the side surface, is formed in the arc-shape where the outer damper portion 15*a* is viewed from the side surface side. This can decrease contact resistance of the outer damper portion 15*a* and the continuous paper P to make a flow of the continuous paper P smooth.

On the lower end portion of the outer damper portion 15*a*, a bearing hole portion 40 is formed. Into this bearing hole portion 40, the rotary shaft S4 is inserted in a fixed state not to rotate. The rotary shaft S4 is disposed parallel to the rotary shaft S3. To this rotary shaft S4, the inner damper portion 15*b* is journaled.

The inner damper portion 15*b* includes supporting portions 41*a*, 41*a* at two sites and a main body portion 41*b*, which is integrally formed on one end sides of them to bridge them. On one ends of the supporting portions 41*a*, 41*a*, a bearing hole portion 41*c* is formed each. Into these bearing hole portions 41*c*, 41*c*, the rotary shaft S4 is inserted. Thus, the inner damper portion 15*b* is rotatably journaled around the rotary shaft S4.

On one end side of the rotary shaft S4, a torsion spring 42 (see FIG. 16 and FIG. 18) is mounted in a state being engaged with the inner damper portion 15*b*. By biasing force of this torsion spring 42, the inner damper portion 15*b* is journaled to the rotary shaft S4 in a swingable state in a vertical direction so that the lower end portion (paper sheet contact portion) of the inner damper portion 15*b* can give tension to the continuous paper P.

On the other hand, a paper sheet contact portion side, where the continuous paper P contacts, on the main body portion 41*b* of the inner damper portion 15*b* is formed in the arc-shape where the inner damper portion 15*b* is viewed from the side surface. This can decrease contact resistance of the inner damper portion 15*b* and the continuous paper P to make the flow of the continuous paper P smooth.

On an opposite surface side of the paper sheet contact portion on the main body portion 41*b*, a depression portion 41*d* is formed. Within this depression portion 41*d*, a plurality of reinforcing plates 41*e* are disposed along the axial direction of the rotary shaft S4 at every predetermined interval. This, while ensuring strength of the inner damper portion 15*b*, can save weight of the inner damper portion 15*b*.

Although disposing a damper function completely separately is considered, in this case, due to the limited space near the damper portion 15, the printer 1 may be enlarged. In contrast, according to the embodiment, as the inner damper portion 15*b* is journaled to the outer damper portion 15*a*, without enlarging the printer 1, even in the case of the inside wound label, the damper function, which can give enough tension, can be added.

Furthermore, according to the embodiment, the outer damper portion 15*a* and the inner damper portion 15*b* as described above, for example, are made of a transparent resin. This can improve visibility below the outer damper portion 15*a* and the inner damper portion 15*b* to more facilitate the operation slipping the continuous paper P under the outer damper portion 15*a* and the inner damper portion 15*b* to insert into the paper passing route. Since the width adjustment guiding portion 27 below the outer damper portion 15*a* can be visually checked, the position setting operation of the width adjustment guiding portion 27 can be facilitated. From such aspect, transparent means that an opposite side of the member is viewable, and transparent material includes colored translucent material and uncolored translucent material as well as uncolored material.

The resin that constitutes the outer damper portion 15*a* and the inner damper portion 15*b* is made of resin that can have deflection to some extent.

It should be noted that between the main body portion 41*b* of the inner damper portion 15*b* and the outer damper portion 15*a*, a gap 43 (see FIG. 15B and FIG. 16) is formed not to obstruct a move of the width adjustment guiding portion 27.

Next, an operational advantage by the damper portion 15 will be described in reference to FIG. 19A to FIG. 21B.

Figure 19A:
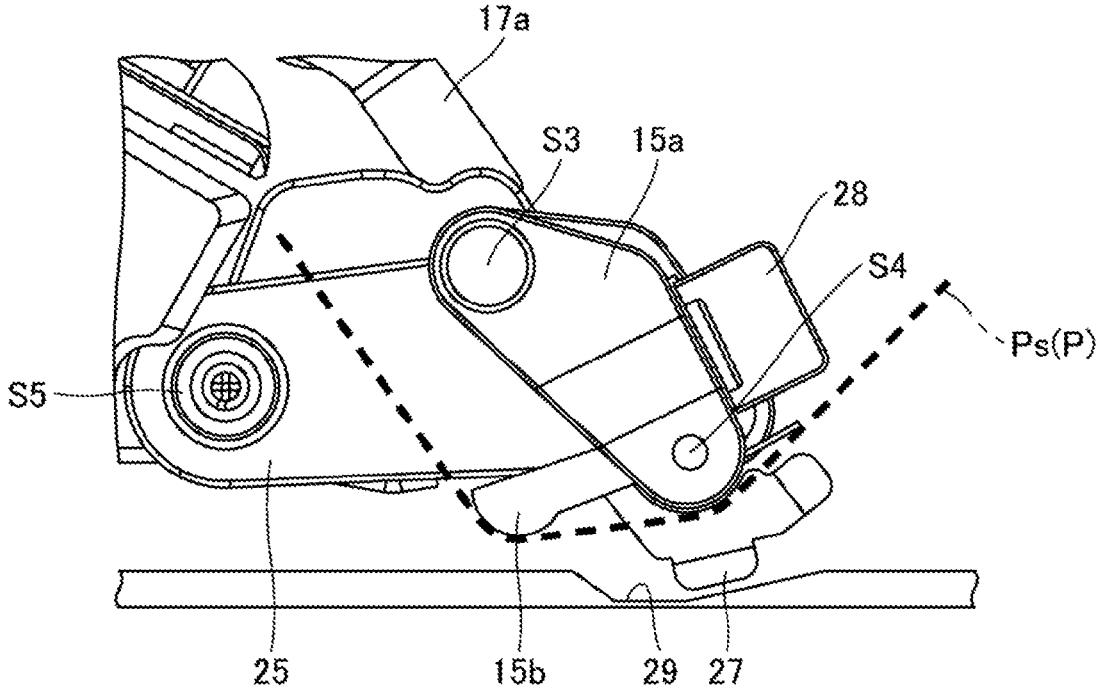
FIG. 19A is an enlarged side view of the damper portion when inserting a continuous paper of an outside wound label.
Figure 19B:
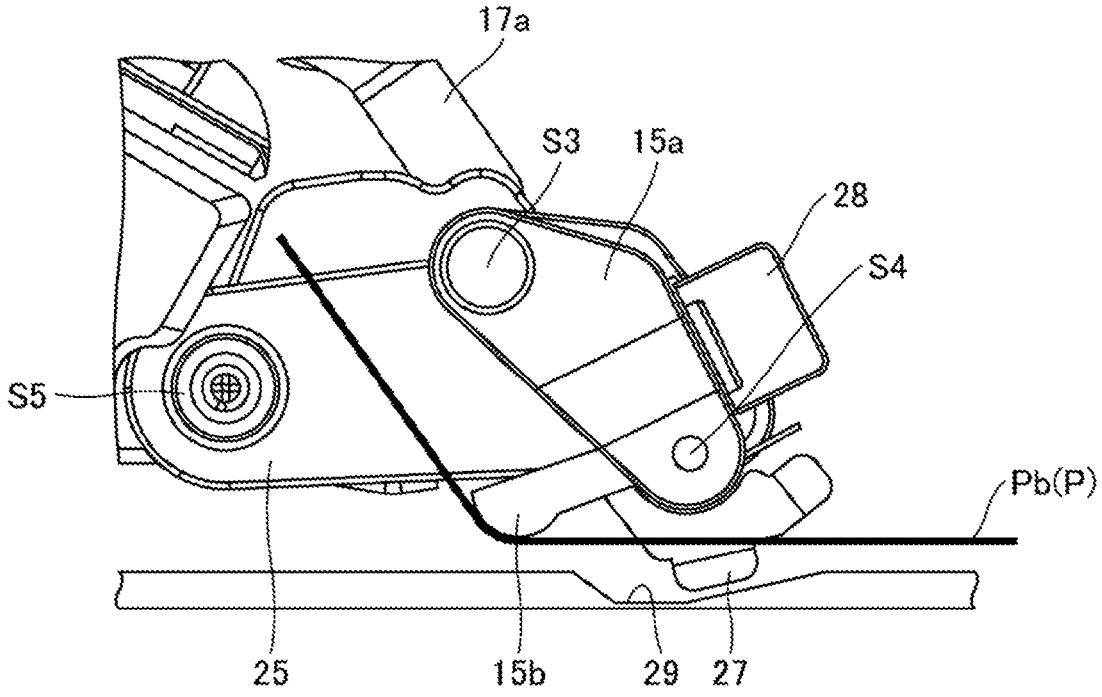
FIG. 19B is an enlarged side view of the damper portion when inserting the continuous paper of an inside wound label.

FIG. 19A is an enlarged side view of the damper portion when inserting the continuous paper of the outside wound label. FIG. 19B is an enlarged side view of the damper portion when inserting the continuous paper of the inside wound label.

As shown in FIG. 19A, in the case of the outside wound label, because the continuous paper Ps is unwound from around the center in the height direction of the paper sheet supply unit 10 to be passed through below the damper portion 15, the continuous paper Ps is inserted into the paper passing route in a state contacting both outer damper portion 15*a* and inner damper portion 15*b*. In view of this, enough tension can be gave to the continuous paper Ps to feed the continuous paper Ps properly and ensure the printing quality.

On the other hand, in the case of the inside wound label, because the continuous paper P is unwound from around the bottom surface inside the printer 1 to be passed through below the damper portion 15, in a case where only the outer damper portion 15*a* is disposed (case without the inner damper portion 15*b*), the continuous paper P may be inserted into the paper passing route without enough tension being gave. In view of this, the continuous paper P may not be fed correctly to deteriorate the printing quality.

In contrast, according to the embodiment, as shown in FIG. 19B, even in the case of the inside wound label, the continuous paper Pb is inserted into the paper passing route in a state contacting the inner damper portion 15*b*. In view of this, even in the case of the inside wound label, the inner damper portion 15*b* can give enough tension to the continuous paper Pb to feed the continuous paper Pb properly and ensure the printing quality.

Figure 20A:
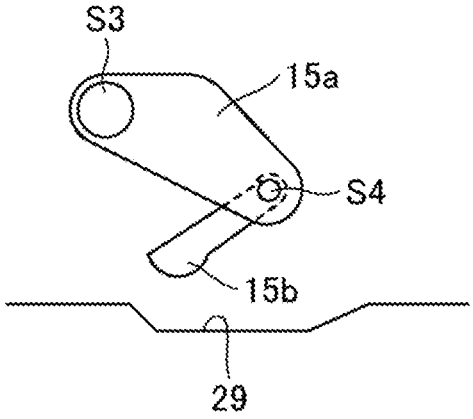
FIG. 20A is a side view of the damper portion at a phase before inserting the continuous paper into the paper passing route.
Figure 20B:
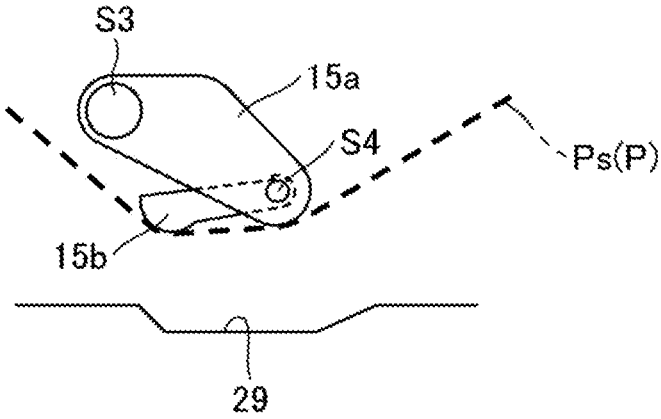
FIG. 20B is a side view of the damper portion in a case of the outside wound label and at a phase where the rolled continuous paper of the paper sheet supply unit has decreased and an outer periphery portion of the rolled continuous paper has closed to a support shaft.
Figure 20C:
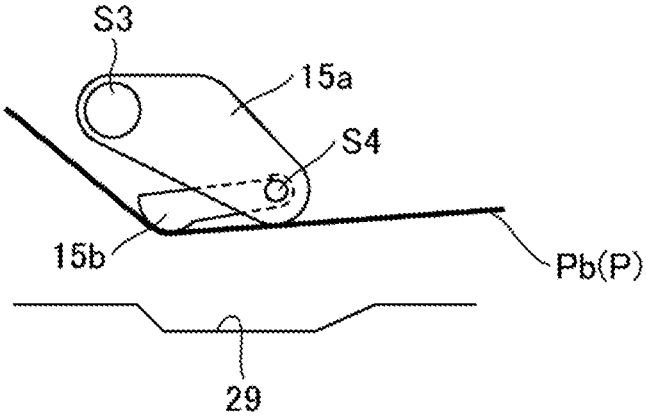
FIG. 20C is a side view of the damper portion in a case of the inside wound label and at a phase where the rolled continuous paper of the paper sheet supply unit has started decreasing.

Next, FIG. 20A to FIG. 20C are side views of the damper portion at respective phases. It should be noted that FIG. 20A illustrates a phase before inserting the continuous paper P into the paper passing route of the printer 1.

FIG. 20B illustrates an exemplary phase that, in the case of the outside wound label, the rolled continuous paper Ps of the paper sheet supply unit 10 has decreased, and an outer peripheral portion of the rolled continuous paper Ps has closed to the support shaft 10*a*. In this case, since a position where the continuous paper Ps is unwound becomes lower than a position at an early stage, although pressing force of the continuous paper Ps against the outer damper portion 15*a* is weakened, and a height of the outer damper portion 15*a* does not change, the inner damper portion 15*b* can rise to give enough tension to the continuous paper Ps.

FIG. 20C illustrates an exemplary phase that, in the case of the inside wound label, the rolled continuous paper Pb of the paper sheet supply unit 10 has started decreasing. In this case, since a position where the continuous paper Pb is unwound becomes a little higher than a position at an early stage, although, while the continuous paper Pb contacts the outer damper portion 15*a*, the pressing force is low, and the height of the outer damper portion 15*a* does not change, the inner damper portion 15*b* can rise to give enough tension to the continuous paper Pb.

Figure 21A:
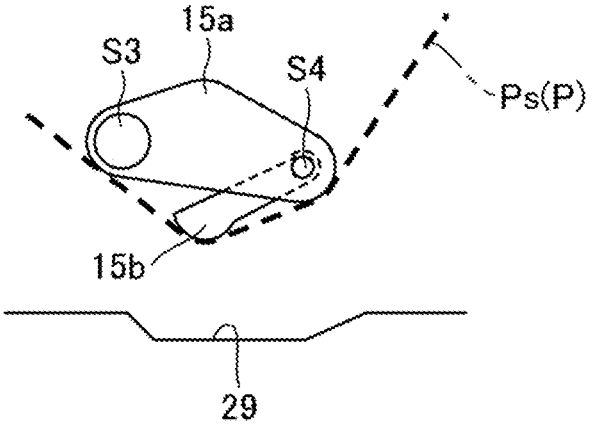
FIG. 21A is a side view of the damper portion in the case of the outside wound label and where the rolled continuous paper of the paper sheet supply unit is at an early stage.

FIG. 21A illustrates an exemplary case that, in the case of the outside wound label, the rolled continuous paper Ps of the paper sheet supply unit 10 is at the early stage. In this case, since the position where the continuous paper Ps is unwound is high, both outer damper portion 15*a* and inner damper portion 15*b* can rise to give enough tension to the continuous paper Ps.

Figure 21B:
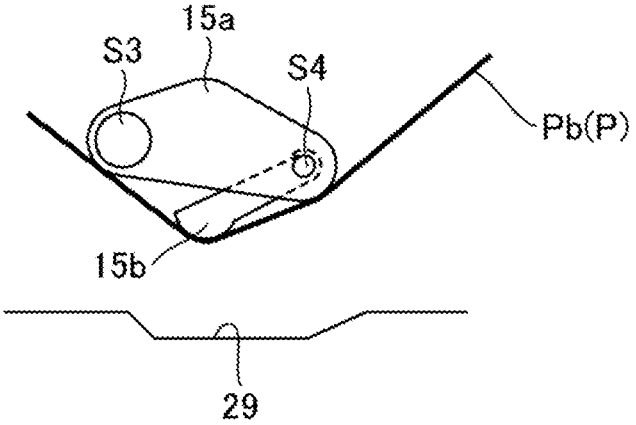
FIG. 21B is a side view of the damper portion in the case of the inside wound label and at a phase where the rolled continuous paper of the paper sheet supply unit has decreased and the outer periphery portion of the rolled continuous paper has closed to the support shaft.

FIG. 21B illustrates an exemplary case that, in the case of the inside wound label, the rolled continuous paper Pb of the paper sheet supply unit 10 has decreased, and an outer periphery portion of the rolled continuous paper Pb has closed to the support shaft 10*a*. In this case, since the position where the continuous paper Pb is unwound becomes higher than the position at the early stage, both outer damper portion 15*a* and inner damper portion 15*b* can rise to give enough tension to the continuous paper Pb.

Figure 22:
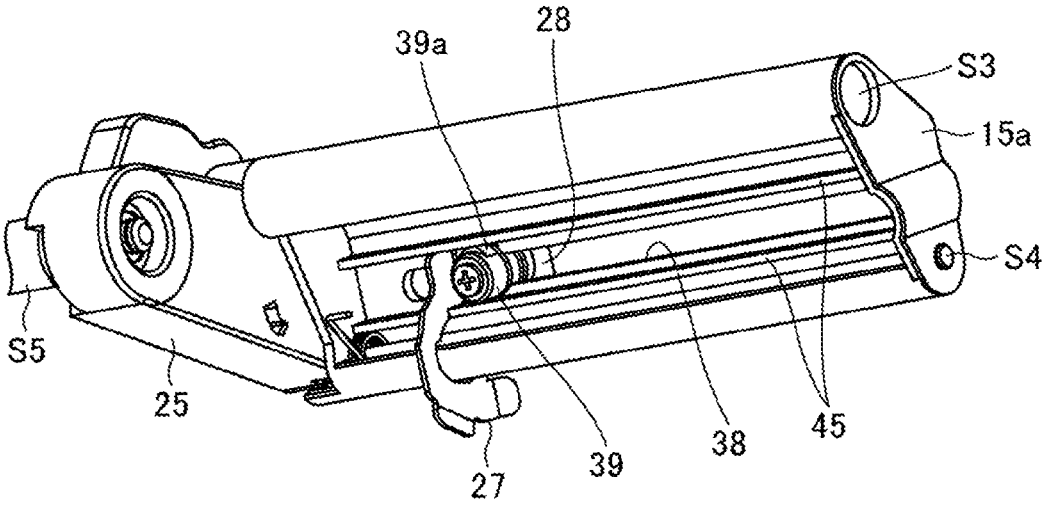
FIG. 22 is a perspective view of the outer damper portion viewed from a front side of the printer.
Figure 23:
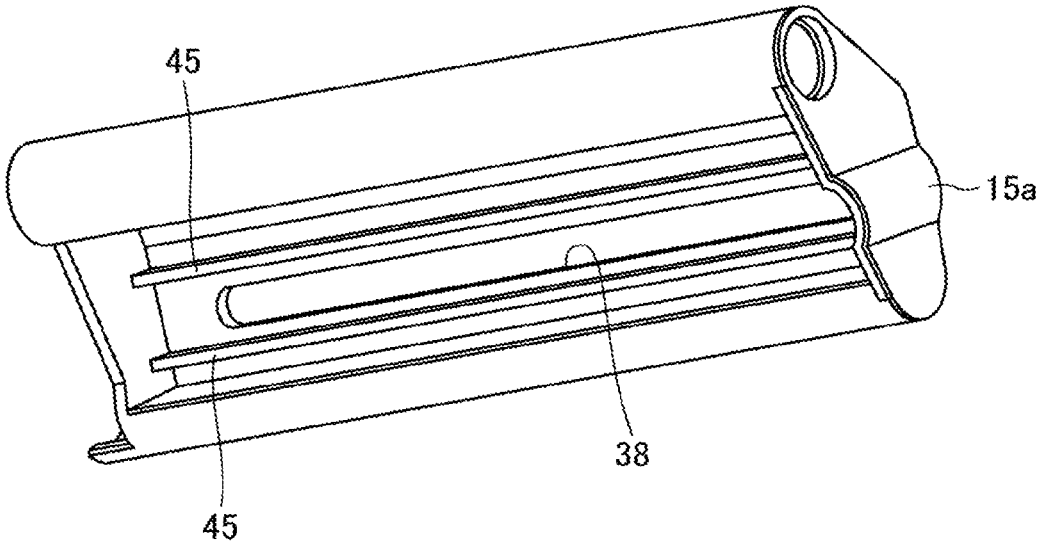
FIG. 23 is a perspective view for illustrating the outer damper portion extracted from FIG. 22.
Figure 24:
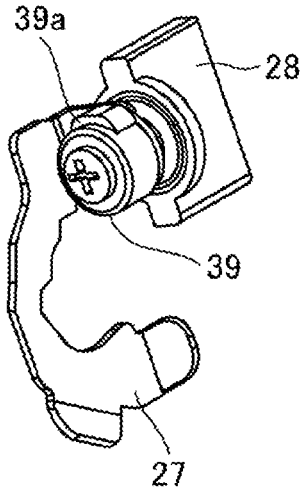
FIG. 24 is a perspective view for illustrating a width adjustment guiding portion and a guide operating portion 28 extracted from FIG. 22.
Figure 25:
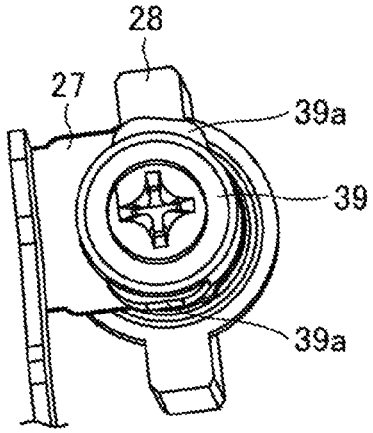
FIG. 25 is a perspective view for illustrating a coupling portion of the width adjustment guiding portion and the guide operating portion.
Figure 26:
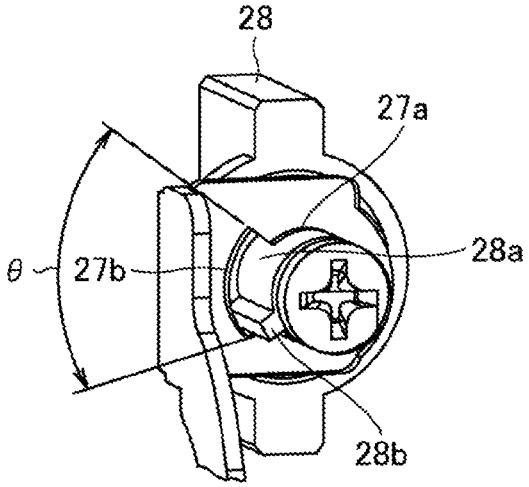
FIG. 26 is a perspective view of an engaging part of a shaft portion of the guide operating portion and the width adjustment guiding portion.
Figure 27:
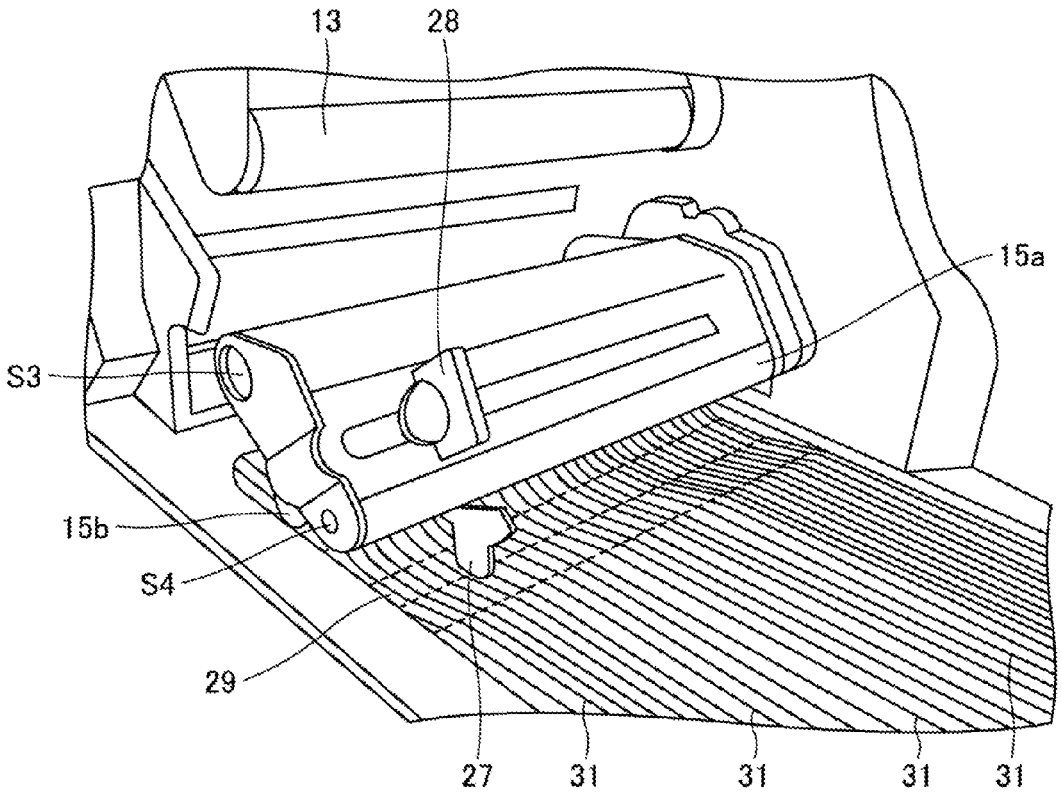
FIG. 27 is a perspective view where the damper portion of the printer in FIG. 1 is viewed from a back side.

Next, the width adjustment guiding portion 27 and the guide operating portion 28 will be described in reference to FIG. 22 to FIG. 27. FIG. 22 is a perspective view of the outer damper portion viewed from a front side of the printer. FIG. 23 is a perspective view for illustrating the outer damper portion extracted from FIG. 22. FIG. 24 is a perspective view for illustrating the width adjustment guiding portion and the guide operating portion 28 extracted from FIG. 22. FIG. 25 is a perspective view for illustrating a coupling portion of the width adjustment guiding portion and the guide operating portion. FIG. 26 is a perspective view of an engaging part of a shaft portion of the guide operating portion and the width adjustment guiding portion. FIG. 27 is a perspective view where the damper portion of the printer is viewed from a back side. It should be noted that, in FIG. 26, in order to see a shaft portion 28*a* of the guide operating portion 28 easily, the pin 39 is omitted. FIG. 27 illustrates an exemplary case where each number of the guide operating portion 28 and the width adjustment guiding portion 27 is one.

As shown in FIG. 22 and FIG. 23, inside the outer damper portion 15*a*, two guide rail portions (a pair of guide rail portions) 45, 45 are formed, as sandwiching an upper and lower portions of the slide hole portion 38, in a state extending along the slide hole portion 38. These two guide rail portions 45, 45 are integrally shaped with the outer damper portion 15*a*, for example, are formed with transparent resin. These two guide rail portions 45, 45, as well as the outer damper portion 15*a*, are constituted of resin that can have deflection to some extent.

As shown in FIG. 22, the pin 39, which couples the width adjustment guiding portion 27 to the guide operating portion 28, is disposed at a position sandwiched between the two guide rail portions 45, 45 of the outer damper portion 15*a*. The pin 39 includes an outer periphery where, as shown in FIG. 22, FIG. 24 and FIG. 25, two convex portions 39*a*, 39*a*, which project in a radial direction to make a diameter of the pin 39 partially long, are formed. The convex portions 39*a*, 39*a* are formed at positions 180 degree away from each other. The guide operating portion 28 includes a tab part formed to be flat plate-shaped, and a position of this flat plate part corresponds to positions of the convex portions 39*a*, 39*a*.

If the guide operating portion 28 is held to turn around the shaft portion 28*a*, the pin 39 also turns. Then, the two convex portions 39*a*, 39*a* of the pin 39 are pressed to the two guide rail portions 45, 45 by a turning position of the pin 39. Thus, the two guide rail portions 45, 45 slack, and the pin 39 is fixed. Here, at a position where the guide operating portion 28 intersects almost vertically with respect to an extending direction of the slide hole portion 38 (that is, in a state where the guide operating portion 28 is disposed longitudinally), the guide operating portion 28 and the width adjustment guiding portion 27 are fixed. Thus, since when the guide operating portion 28 is in a fixed state, the guide operating portion 28 is in a longitudinal state, range where the guide operating portion 28 interrupts with field of view can be reduced.

On the other hand, if the guide operating portion 28 is turned further 90 degree from the fixed state, since the two convex portions 39*a*, 39*a* of the pin 39 separate from the two guide rail portions 45, the fixed state of the pin 39 is released. Here, at a position where the guide operating portion 28 is almost horizontal with respect to the extending direction of the slide hole portion 38 (that is, in a state where the guide operating portion 28 is laid laterally), the fixed states of the guide operating portion 28 and the width adjustment guiding portion 27 are released.

Accordingly, according to the embodiment, with a simple structure and a simple operation, a position of the width adjustment guiding portion 27 can be set. According to the embodiment, since the outer damper portion 15*a* is transparent, the width adjustment guiding portion 27 can be visually perceived via the outer damper portion 15*a*. In view of this, a relative relationship of a posture of the guide operating portion 28 (longitudinal or lateral) and a posture of the width adjustment guiding portion 27 (constantly longitudinal), ensures a confirmation at one view whether the guide operating portion 28 is in the fixed state or the fix-released state.

As shown in FIG. 26, the shaft portion 28*a* of the guide operating portion 28 includes an outer periphery, on which a convex portion 28*b* is formed. At the width adjustment guiding portion 27, on an outer periphery of a hole 27*a* where the shaft portion 28*a* of the guide operating portion 28 is inserted, a range setting hole 27*b* is formed in a state communicating with the hole 27*a*. The convex portion 28*b*, which is disposed within the range setting hole 27*b*, can turn the guide operating portion 28 in a range of θ in a circumferential direction of the range setting hole 27*b*.

Further, as shown in FIG. 27, on the bottom surface of the printer 1 (below the damper portion 15), a plurality of convex portions 31, which project from this bottom surface and extend along the feed direction of the continuous paper P, are arranged along the width direction of the continuous paper P (a longitudinal direction of the damper portion 15). This convex portion 31 is disposed to reduce a contacted area of the continuous paper P and the bottom surface of the printer 1 so that an adhesive surface of the continuous paper P does not stick to the bottom surface of the printer 1 when mainly using a linerless label (a continuous label including an adhesive surface at one surface) as the continuous paper P.

According to the embodiment, since the outer damper portion 15*a* and the inner damper portion 15*b* are transparent, the width adjustment guiding portion 27 and the convex portion 31 can be visually checked via the outer damper portion 15*a* and the inner damper portion 15*b*. In view of this, a relative positional relationship of the width adjustment guiding portion 27 and the convex portion 31 ensures an estimation whether or not a fixed position of the width adjustment guiding portion 27 is appropriate.

Next, an operational advantage by disposing the depression portion 29 below the damper portion 15 will be described in reference to FIG. 19A, FIG. 19B, and similar drawings.

In a case where the depression portion 29 does not exist below the damper portion 15 and the bottom surface inside the printer 1 is flat, if the continuous paper P is returned from the printing unit 11 to a paper sheet supply unit 10 side, what is called, back feeding is executed, the continuous paper P slacks to contact the bottom surface inside the printer 1. In this case, since the lower portion of the width adjustment guiding portion 27 of the damper portion 15 is positioned above the bottom surface inside the printer 1, the continuous paper is positioned below a lower end of the width adjustment guiding portion. Therefore, the continuous paper may get out of range determined by the width adjustment guiding portion. Thus, returning to the printing operation in this state causes the continuous paper to run on the width adjustment guiding portion and be fed in a state where the damper portion does not function. This results in a printing position displaced from a planned position, a thinned printing density, and ends up with a problem that printing quality is deteriorated. Especially in the case where a width of the continuous paper is short, the continuous paper often deviates from the width adjustment guiding portion. The rolled continuous paper loaded in a paper sheet supply unit may slack due to an inertia of rotation.

In contrast, according to the embodiment, so that the lower portion of the width adjustment guiding portion 27 of the damper portion 15 is positioned below the bottom surface inside the printer 1, the depression portion 29 is disposed on the bottom surface inside the printer 1. Thus, since the lower portion of the width adjustment guiding portion 27 of the damper portion 15 is positioned below a line on the bottom surface inside the printer 1, the continuous paper P does not get out of range determined by the width adjustment guiding portion 27. In view of this, when returning to the printing operation, since the continuous paper P also does not run on the width adjustment guiding portion 27, the function of the damper portion 15 is not also hindered. Accordingly, this avoids the trouble, such as the printing position displaced off from the planned position, and a thinned printing density, thus ensuring the printing quality of the printer 1.

A cross-sectional shape of the depression portion 29 is formed so that an incline of the rear (upstream of feed at the printing process) is more gradual than an incline of the front (downstream of feed at the printing process). An inner wall surface of the depression portion 29 may be approximately perpendicular to the bottom surface inside the printer 1.

On the bottom surface inside the printer 1 including the depression portion 29, a plurality of protrusions (not illustrated), which extend along the feed direction of the continuous paper P, may be disposed along the width direction of the continuous paper P at every predetermined interval. These can make the flow of the continuous paper P smooth at the back feeding to reduce or prevent a trouble that the continuous paper P jams below the damper portion 15.

Next, the operation inserting the continuous paper P into the paper passing route of the printer 1 will be described in reference to FIG. 8, FIG. 9, and similar drawings.

First, pulling the head lock lever portion 16 of the printing unit 11 shown in FIG. 8 rightward in FIG. 8, in conjunction with its operation, the lock claw portion 22 moves rightward to deviate from the pin 20. Then, as shown in FIG. 9, while the front portion of the printing head portion 13 automatically opens above by the biasing force of the torsion spring 21 (see FIG. 10 and similar drawings), in conjunction with its operation, the rear portion of the damper supporting member 25 rises by the biasing force of the torsion spring 30 (see FIG. 10 and similar drawings), and the damper portion 15 also rises automatically. This can extend a width below the damper portion 15.

Subsequently, the continuous paper P unwound from the paper sheet supply unit 10 passes through below the damper portion 15, and then passes through between the printing head portion 13 and the supporting stand 14. In this respect, since the damper portion 15 has rose and is open, the operation inserting the continuous paper P can be facilitated.

Thereafter, as shown in FIG. 8, if the front portion of the printing head portion 13 is depressed to close the printing head portion 13, in conjunction with its operation, the rear portion of the damper supporting member 25 decreases against the biasing force of the torsion spring 30, and the damper portion 15 also decreases automatically. This can prevent the damper portion 15 from to be failed to close to give tension by the damper portion 15 to the continuous paper P at the printing process. Accordingly, the continuous paper P can be fed properly to ensure the printing quality.

As described above, the invention made by the present inventor has been described specifically based on the embodiment. However, it should be understood that the embodiment disclosed herein is for illustrative purposes in all respects, and is not limited to the technique disclosed. That is, the technical scope of the present invention should not be construed in a restrictive manner based on the description in the embodiment, should be construed in accordance with the description in a range of the claim as a principle, and the technique identical to the technique disclosed in a range of the claim and all changes within the scope of the claim are included.

For example, according to the embodiment, a case that a continuous paper, which includes a plurality of labels adhered temporarily on a liner sheet, is used as a print medium has been described, but this should not be construed in a limiting sense; for example, a continuous label including an adhesive surface on one surface (label without liner sheet), a continuous sheet without an adhesive surface (continuous sheet), or, not limited to papers, a printable film by a thermal head or a similar film can be used as a print medium. The label without liner sheet, the continuous sheet, or the film can include a position detection mark. In the case where the label without liner sheet, where an adhesive is exposed, or a similar label is fed, a roller including silicone may be disposed while a non-adhesive coating is applied to a feed path.

In the above description, the present invention has been described in a case applying to a stand-alone type printer, where an input operation to the printer is executed without a personal computer, but this should not be construed in a limiting sense; for example, the present invention may also apply to an on-line type printer, where the input operation to the printer is executed via the personal computer.

This application claims the priority based on Patent Application No. 2013-268269 filed in the Japan Patent Office on Dec. 26, 2013, and every content of this application is incorporated herein by reference.

The invention claimed is:

1. A printer comprising:

a medium supply portion configured to supply a print medium;

a feeding unit configured to feed the print medium supplied from the medium supply portion along a medium feed path;

a printing unit disposed in the medium feed path to print on the print medium;

a damper portion configured to swing to give tension to the print medium between the printing unit and the medium supply portion, the damper portion being made of a transparent material; and a width adjustment guiding portion disposed on the damper portion to contact an end portion in a width direction of the print medium to guide the print medium to be fed, the width adjustment guiding portion being configured to move.

2. The printer according to claim 1, comprising a guide operating portion as a tab configured to move the width adjustment guiding portion and to fix a position of the width adjustment guiding portion.

3. The printer according to claim 2, wherein turning the guide operating portion ensures fixing or fix-releasing a position of the guide operating portion.

4. The printer according to claim 2, wherein the guide operating portion is flat plate-shaped, and when the guide operating portion is disposed in a parallel direction with a feed direction of the print medium, the width adjustment guiding portion is fixed, and when the guide operating portion is disposed in an intersecting direction with the feed direction, the width adjustment guiding portion is fix-released.

5. The printer according to claim 1, wherein the width adjustment guiding portion is positioned on an inferior surface of the damper portion.

6. The printer according to claim 1, wherein the damper portion includes:

a slide hole portion formed along a longitudinal direction of the damper portion;

a pair of guide rail portions formed along the slide hole portion to sandwich the slide hole portion in a vertical direction;

a guide operating portion configured to turn and coupled to the width adjustment guiding portion at a position sandwiched between the pair of guide rail portions, the guide operating portion including a convex portion projecting in a radial direction to an outer periphery along the turning direction, the width adjustment guiding portion being configured to move along the slide hole portion.

* * * * *